US010219057B2

(12) United States Patent
Luce et al.

(10) Patent No.: US 10,219,057 B2
(45) Date of Patent: Feb. 26, 2019

(54) AUDIO MODULE FOR AN ELECTRONIC DEVICE

(71) Applicant: Apple Inc., Cupertino, CA (US)

(72) Inventors: Thomas R. Luce, San Jose, CA (US); Anthony P. Grazian, Los Gatos, CA (US); Hongdan Tao, Campbell, CA (US); Christopher Wilk, Los Gatos, CA (US); Daniel W. Jarvis, Sunnyvale, CA (US); David A. Pakula, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/699,064

(22) Filed: Sep. 8, 2017

(65) Prior Publication Data

US 2018/0084323 A1 Mar. 22, 2018

Related U.S. Application Data

(60) Provisional application No. 62/398,065, filed on Sep. 22, 2016.

(51) Int. Cl.

| | |
|---|---|
| ***H04R 1/02*** | (2006.01) |
| ***H04R 1/28*** | (2006.01) |
| ***H04R 7/18*** | (2006.01) |
| ***H04R 9/02*** | (2006.01) |
| ***H04R 9/06*** | (2006.01) |

(52) U.S. Cl.

CPC ..... *H04R 1/025* (2013.01); *H04R 1/023* (2013.01); *H04R 1/028* (2013.01); *H04R 1/2811* (2013.01); *H04R 7/18* (2013.01); *H04R 9/025* (2013.01); *H04R 9/06* (2013.01); *H04R 2400/11* (2013.01); *H04R 2499/11* (2013.01)

(58) Field of Classification Search

CPC ..... H04R 1/025; H04R 1/023; H04R 1/028; H04R 1/2811; H04R 7/18; H04R 9/025; H04R 9/06; H04R 2400/11; H04R 2499/11

See application file for complete search history.

(56) References Cited

U.S. PATENT DOCUMENTS

| | | | | |
|---|---|---|---|---|
| 5,710,395 | A | 1/1998 | Wilke | |
| 6,493,456 | B1 * | 12/2002 | Hansson | H04M 1/03 381/345 |
| 6,758,304 | B1 | 7/2004 | McLean | |
| 8,885,867 | B1 | 11/2014 | Tai et al. | |
| 2004/0084242 | A1 | 5/2004 | Masuda | |

(Continued)

FOREIGN PATENT DOCUMENTS

| | | |
|---|---|---|
| EP | 0810812 | 12/1997 |
| WO | 2018057862 | 3/2018 |

OTHER PUBLICATIONS

International Search Report and Written Opinion in PCT Application No. PCT/US2017/052918, dated Nov. 30, 2017 in 13 pages.

*Primary Examiner* — David L Ton

(74) *Attorney, Agent, or Firm* — Kilpatrick Townsend and Stockton, LLP

(57) ABSTRACT

An electronic device is disclosed that includes one or more sealed audio modules that are unaffected by changes in the internal pressure within the electronic device. The audio modules can also include one or more features that increase the audible bandwidth of the electronic device.

20 Claims, 21 Drawing Sheets

(56) References Cited

U.S. PATENT DOCUMENTS

| | | | | |
|---|---|---|---|---|
| 2004/0170291 | A1 | 9/2004 | Eaton | |
| 2005/0233781 | A1* | 10/2005 | Erixon ..... | H04M 1/035<br>455/575.1 |
| 2007/0154053 | A1 | 7/2007 | Yang | |
| 2012/0300968 | A1 | 11/2012 | Sun | |
| 2013/0170688 | A1 | 7/2013 | Cohen et al. | |

* cited by examiner

AUDIO MODULE FOR AN ELECTRONIC DEVICE

CROSS-REFERENCES TO OTHER APPLICATIONS

This application claims priority to U.S. provisional patent application Ser. No. 62/398,065, for "CLOSED AUDIO MODULE IN AN ELECTRONIC DEVICE" filed on Sep. 22, 2016 which is hereby incorporated by reference in entirety for all purposes.

FIELD

The following description relates to an electronic device. In particular, the following relates to a portable electronic device that includes a sealed audio module that is positioned within the electronic device and is configured to emit sound from an aperture disposed within an external housing of the electronic device.

BACKGROUND

An electronic device may include a touch sensitive display secured to an housing to form an enclosure that stores several internal components, such as a battery and a processor circuit. The electronic device can also include one or more speakers designed to emit audible sound. The one or more speakers may be negatively affected by pressure fluctuations within the electronic device that are caused by a user pressing on the touch sensitive display.

SUMMARY

Some embodiments of the disclosure pertain to an audio module for an electronic device that is unaffected by pressure fluctuations within the electronic device that could be caused, for example, by pressure against a touch screen of the electronic device. Further embodiments can include features that enable the audio module to be positioned within an electronic device having a relatively thin profile. In some embodiments a portion of the back volume of the acoustic module can be positioned in front of the speaker plane to more effectively utilize available space within the electronic device. Various embodiments can include a U-shaped channel that enables the sound port of the acoustic module to be positioned away from the diaphragm. Some embodiments include a resonant cavity that can be positioned within a portion of the back volume and employed to compensate for any negative effects on the acoustic performance due to the U-shaped channel.

In some embodiments an audio module for an electronic device comprises a driver assembly comprising a diaphragm defining a speaker plane, a voice coil attached to the diaphragm and positioned adjacent one or more magnets, and an enclosure surrounding the driver assembly. The enclosure defines a front volume positioned on a first side of the speaker plane and coupled to a sound port, a back volume positioned on the first side of the speaker plane and on a second side of the speaker plane, and a resonant cavity coupled to the front volume via a resonant cavity port and separated from the back volume by a resonant cavity cover.

In some embodiments a first portion of the resonant cavity is positioned on the first side of the speaker plane and a second portion of the resonant cavity is positioned on the second side of the speaker plane. In various embodiments the back volume is further defined by a frame, the diaphragm and a rear cover attached to the frame. In some embodiments the driver assembly includes a bottom flux plate that forms a portion of the rear cover. In various embodiments a substantially U-shaped channel couples the front volume to the sound port.

In some embodiments the audio module further comprises a panel of acoustic mesh positioned within the substantially U-shaped channel and partially embedded within one or more walls that define the substantially U-shaped channel. In various embodiments the panel of acoustic mesh is oriented at an angle with respect to the speaker plane.

In some embodiments the resonant cavity is sized to resonate at a frequency that extends a bandwidth of the audio module. In various embodiments the audio module further comprises a barometric vent coupling the front volume to the back volume.

In some embodiments an audio module for an electronic device comprises a frame, a driver assembly disposed within the audio module and including a diaphragm positioned within a speaker opening in the frame and a front cover attached to the frame and positioned parallel to and spaced apart from the diaphragm in a first direction, wherein the front cover, the diaphragm and the frame define a front volume. A front volume aperture is positioned transverse to the diaphragm such that sound from the diaphragm exits the front volume in a direction parallel to the diaphragm. A rear cover is attached to the frame and positioned parallel to and spaced apart from the diaphragm in a second direction that is opposite the first direction. A substantially U-shaped channel couples acoustic energy from the front volume aperture to a sound port defined by the frame. A panel of acoustic mesh is positioned within the substantially U-shaped channel and has a perimeter embedded within a portion of the frame.

In some embodiments the substantially U-shaped channel includes a first portion that receives sound from the front volume and is positioned adjacent a perimeter of the diaphragm, a second portion that receives sound from the first portion and is oriented transverse to the first portion and a third portion that directs sound received from the second portion to the sound port and is coupled to a distal end of the second portion. In various embodiments a portion of the substantially U-shaped channel is formed by a channel cover that is attached to the frame.

In some embodiments the panel of acoustic mesh is oriented at an angle with respect to a plane of the diaphragm. In various embodiments the panel of acoustic mesh is insert-molded within the frame.

In some embodiments an electronic device comprises a device enclosure, a display assembly coupled to the device enclosure, the combination thereof defining an interior volume and wherein the display assembly includes a touch sensitive layer and a force sensitive layer. An audio module is disposed within the interior volume and comprises (1) a driver assembly including a diaphragm defining a speaker plane, and a voice coil attached to the diaphragm and positioned adjacent one or more magnets. The audio module further comprises (2) an audio module enclosure surrounding the driver assembly and defining a front volume coupled to a speaker opening formed in the device enclosure, a back volume positioned on the first side of the speaker plane and on a second side of the speaker plane, and a resonant cavity coupled to the front volume via a resonant cavity port and separated from the back volume by a resonant cavity cover.

In some embodiments the electronic device further comprises a top flux plate in contact with a top surface of the one or more magnets and a bottom flux plate in contact with a bottom surface of the one or more magnets. In various embodiments the audio module further comprises a substantially U-shaped channel that couples the front volume to the speaker opening.

In some embodiments a panel of acoustic mesh is positioned within the substantially U-shaped channel and is oriented at an angle with respect to the speaker plane. In various embodiments the back volume is further defined by a frame, the diaphragm and a rear cover attached to the frame. In some embodiments the electronic device further comprises a barometric vent coupling the front volume to the back volume.

Other embodiments of the disclosure pertain to different enhancements over traditional devices. For example, in one embodiment and electronic device may include a protective layer formed from a transparent material. The electronic device may further include a display assembly. The display assembly may include a touch sensitive layer that detects a touch input to the protective layer. The display assembly may further include a force sensitive layer that detects an amount of force from the touch input. The display assembly may further include a display between touch sensitive layer and the force sensitive layer. In some embodiments, the display at least partially bends around the force sensitive layer defining a bent region. The electronic device may further include a frame that carries the protective layer. The frame may include a notch that at least partially receives the display at the bent region.

In another aspect, an electronic device is described. The electronic device may include a protective layer formed from a non-metal material. The electronic device may further include an enclosure formed from a metal. The enclosure may include a support region that receives the outer protective layer. In some embodiments, the protective layer and the enclosure define an internal cavity. The electronic device may further include an operational component positioned in the internal cavity. The operational component may generate heat when performing an operation. The electronic device may further include a thermal distribution assembly secured with the enclosure and the protective layer. The thermal distribution assembly may draw the heat from the internal component and dispersing the heat to the enclosure.

In another aspect, an electronic device is described. The electronic device may include an enclosure defining an internal cavity. The electronic device may further include a circuit assembly disposed in the internal cavity. The circuit assembly may include a first circuit board that includes a first surface and a second surface opposite the first surface. The first surface may include a first operational component and the second surface may include a second operational component. The circuit assembly may further include a second circuit board electrically coupled with the first circuit board. The second circuit board may include a third surface that faces the second surface. Also, the third surface may include a third operational component.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The disclosure will be readily understood by the following detailed description in conjunction with the accompanying drawings, wherein like reference numerals designate like structural elements, and in which.

Figure 1:
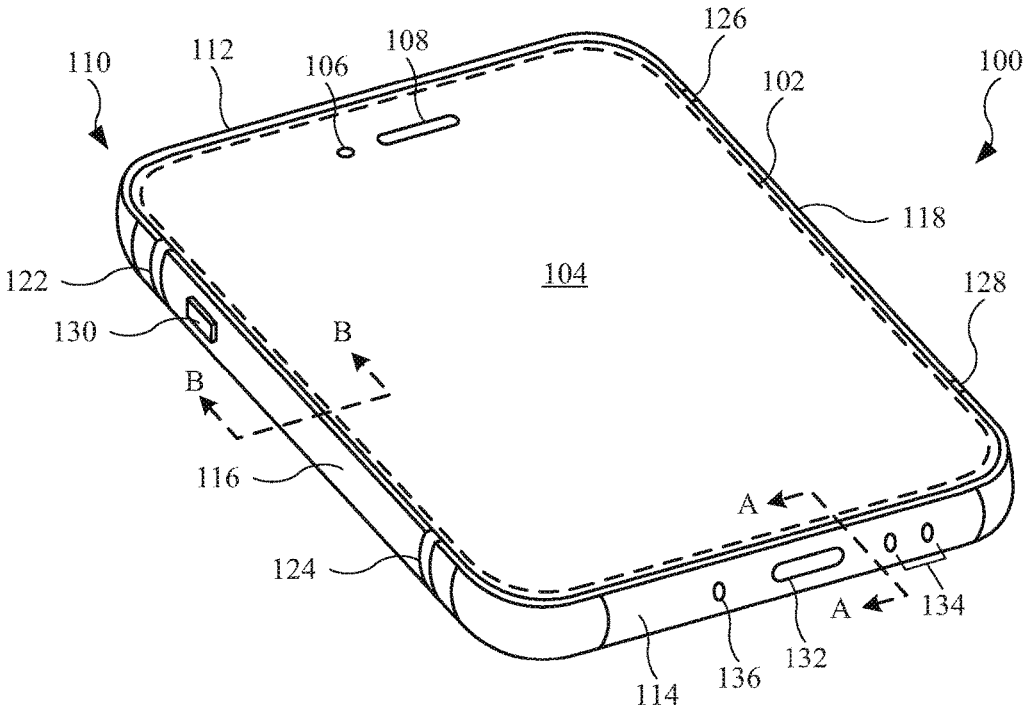
FIG. 1 illustrates a front isometric view of an embodiment of an electronic device, in accordance with some described embodiments.

Those skilled in the art will appreciate and understand that, according to common practice, various features of the drawings discussed below are not necessarily drawn to scale, and that dimensions of various features and elements of the drawings may be expanded or reduced to more clearly illustrate the embodiments of the present invention described herein.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting such that other embodiments may be used, and changes may be made without departing from the spirit and scope of the described embodiments.

In some embodiments an audio module is disclosed that can be used within an electronic device to generate sound for a user. In one example the audio module is a receiver for a cellular telephone and can include features for enhanced audio performance as described in more detail below.

In some embodiments the audio module is unaffected by pressure fluctuations within the electronic device that could be caused, for example, by pressure against a touch screen of the electronic device. More specifically, when a force is applied to the touch screen the touch screen deflects causing an internal volume of the electronic device to be momentarily reduced which in turn results in an increase of the air pressure within the electronic device. Since the audio module is located within the electronic device it is subjected to the increase in air pressure. To protect the audio module from altering its acoustic output in response to the momentary increase in air pressure the audio module can include a completely sealed enclosure that has a sound port that is sealed to the enclosure of the electronic device so the only opening the audio module has is to the external environment outside of the electronic device.

Further embodiments can include features that enable the audio module to be positioned within an electronic device having a relatively thin profile. In some embodiments a portion of the back volume of the acoustic module can be positioned in front of the speaker plane to more effectively utilize available space within the electronic device. Various embodiments can include a U-shaped channel that enables the sound port of the acoustic module to be positioned away from the diaphragm. More specifically, the U-shaped channel can function as a sound channel that enables acoustic energy generated by the driver assembly to be ported to a location remote from the driver assembly and out of the electronic device enclosure. A resonant cavity can be positioned within a portion of the back volume and employed to compensate for any negative effects on the acoustic performance due to the U-shaped channel. Further details of the audio module and its various features for enhanced audio performed are described in more detail below.

In other embodiments, the disclosure relates to an electronic device. The electronic device may include several enhancements over traditional devices. For example, the electronic device may include an enclosure and a display that extends (approximately) to the enclosure, thereby maximizing the size of the display. The display may be part of a display assembly that further includes a touch sensitive layer and a force sensitive layer. In order to accommodate the increased display size, a border that surrounds the display may decrease in size. However, the reduced presence of the border may expose electrical and mechanical connections between the display and internal components within the enclosure. In order to hide these connections, the display assembly components may be electrically and mechanically coupled with their respective flexible circuits in different locations. For example, the touch sensitive layer and the display may electrically and mechanically couple with their flexible circuits at one location inside the electronic device, while the force sensitive layer electrically and mechanically couples with a flexible circuit at a different location away from the electrical and mechanical connections between the touch sensitive layer, the display, and their respective flexible circuits. Also, by routing the electrical and mechanical connection in different locations, the volume occupied by the display assembly is reduced, and the internal volume of the electronic device may be used by a different component(s) in the electronic device.

The electronic device may further include a circuit assembly designed to occupy less space in the electronic device. For example, the circuit assembly may be divided into a first circuit board stacked over a second circuit board, thereby reducing the footprint of the circuit assembly in two dimensions. Also, the aforementioned circuit boards may include operational components (such as integrated circuits or processor circuits) positioned on multiple, different surfaces. The operational components may perform an operation (or operations) such as executing instructions from a software application stored on a memory circuit. As an example, the first circuit board may include a first surface and a second surface opposite the first surface, with each surface having one or more operational components. Also, the circuit board assembly may include several interposers designed to route signals between the first and second circuit boards, such that the first and second circuit boards (as well as their respective operational component) are in communication with one another.

The electronic device may further include an internal power supply (battery). Due in part to the modifications to the display assembly and the circuit board assembly that create additional volume, the internal power supply may occupy at least some of the additional volume, thereby increasing the size of the internal power supply as well as the charge capacity of the internal power supply. Also, additional components, such as antennae and circuits, may be repositioned in the electronic device in order to increase the size of the internal power supply.

Also, in some instances, the enclosure may include a metal band coupled with a protective layer that covers the display assembly. The enclosure may further include an additional protective layer coupled with the metal band. The additional protective layer may include a glass material. When the circuit assembly generates heat, it may be necessary to remove the heat from the internal volume to avoid damage to a component (or components) in the electronic device. In this regard, the electronic device may include a thermal distribution assembly formed from several layers of metal, one of which may include a relatively high thermal conductivity. The thermal distribution assembly is designed to transfer the heat from the heat-generating component(s) to the metal band, where the heat can dissipate from the electronic device.

Also, when a user interacts with the display assembly, the force sensitive layer may determine an amount of force exerted on the display in order to generate a command in accordance with the amount of force. However, the force applied to the display (by way of the protective layer) may reduce the internal volume momentarily, and as a result, increase the internal air pressure. The increased internal pressure may affect other components, such as an audio module designed to generate acoustical energy. In order to shield the audio module from increased pressure, the receiver may include an enclosed back volume. In this manner, the audio module is unaffected from pressure changes in the electronic device as the enclosed back volume does not change based on pressure changes.

These and other embodiments are discussed below with reference to FIGS. 1-29.

However, those skilled in the art will readily appreciate that the detailed description given herein with respect to these Figures is for explanatory purposes only and should not be construed as limiting.

FIG. 1 illustrates a front isometric view of an embodiment of an electronic device 100, in accordance with some described embodiments. In some embodiments, the electronic device 100 is a tablet computer device. In the embodiment shown in FIG. 1, the electronic device 100 is a mobile communication device, such as a smartphone. Accordingly, the electronic device 100 may enable wireless communication in the form of cellular network communication, Bluetooth communication (2.4 GHz), and/or wireless local area network (WLAN) communication (2.4 GHz to 5 GHz), as non-limiting examples.

As shown, the electronic device 100 may include a display assembly 102 (shown as a dotted line) designed to present visual information in the form of textual information, still images, and/or video information. Although not shown, the display assembly 102 may further include a touch sensitive layer designed to detect a touch input to the display assembly 102 in order to control an output of the display assembly 102. Also, the display assembly 102 may further include a force sensitive layer designed to detect an amount of force exerted on the display assembly 102. The determined amount of force may correspond to a particular input or command to the display assembly 102. For example, different detected amounts of force may correspond to different or distinct commands. In order to protect the display assembly 102, the electronic device 100 may include a first protective layer 104 that overlays the display assembly 102. The first protective layer 104 may include a transparent material(s), including glass or sapphire, as non-limiting examples.

As shown, the first protective layer 104 may include openings that facilitate user interaction with the electronic device 100. For example, the first protective layer 104 may include a first opening 106 and a second opening 108. The electronic device 100 may include an image capture device (not shown) that captures an image (or images) through the first opening 106. The electronic device 100 may further include an audio module (not shown) located near the second opening 108, with the audio module generating acoustical energy in the form of audible sound, and emits the acoustical energy through the second opening 108.

Also, the electronic device 100 may include a band 110 that defines an outer perimeter of the electronic device 100. Generally, the band 110 includes a shape similar to that of a ring. Also, the band 110 may define multiple sidewalls and an opening to at least partially receive the first protective layer 104 and a second protective cover (not shown). In some embodiments, the band 110 includes a metal, such as aluminum. In this regard, the band 110 may provide a rigid support structure for the electronic device 100. Also, when the band 110 is formed from a metal, the band 110 may be used to support wireless communication. For example, the band 110 may include a first part 112 that forms a U-shape design, as well as a second part 114 that also forms a U-shape design. The first part 112 and the second part 114 may each electrically couple to a radio circuit (not shown) in the electronic device 100 such that the first part 112 and the second part 114 each form at least part of an antenna for their respective radio circuits. For example, the first part 112 may electrically couple with a WLAN radio circuit, and the second part 114 may electrically couple with a cellular network radio circuit.

Also, the band 110 may further include a third part 116 and a fourth part 118, with the third part 116 and the fourth part 118 separated from both the first part 112 and the second part 114 by split regions, or openings. For example, the band 110 may include a first split region 122 and a second split region 124 that combine to separate the third part 116 from the first part 112 and the second part 114. Also, the band 110 may include a third split region 126 and a fourth split region 128 that combine to separate the fourth part 118 from the first part 112 and the second part 114. The aforementioned split regions may be filled with a non-metal material, such as molded plastic, to provide a flush, co-planar surface with the various parts of the band 110. Also, the first part 112, the second part 114, the third part 116, and the fourth part 118 may each represent a first sidewall, a second sidewall, a third sidewall, and a fourth sidewall, respectively.

The electronic device 100 may further include a first button 130 designed to generate an input when depressed. The input may generate an electrical signal received by a processor circuit (not shown) in the electronic device 100, in order to alter the visual information presented on the display assembly 102. As shown, the first button 130 is located along the third part 116. However, other locations are possible.

Also, although not shown, the electronic device 100 may include a switch designed to provide an additional user input function.

Also, the electronic device 100 may further include a data port 132 designed to receive and electrically couple with a cable assembly (not shown). The data port 132 may receive data/communication from the cable assembly, as well as electrical energy to charge an internal power supply (not shown) located in the electronic device 100. Also, the electronic device 100 may include additional openings designed for various user interactions. For example, the electronic device 100 may include an audio module (not shown) located near openings 134 such that the openings 134 allow acoustical energy generated from the audio module to exit the electronic device 100. Also, the electronic device 100 may further include a microphone (not shown) located near an opening 136. The microphone may be positioned to receive acoustical energy through the opening 136.

Figure 2:
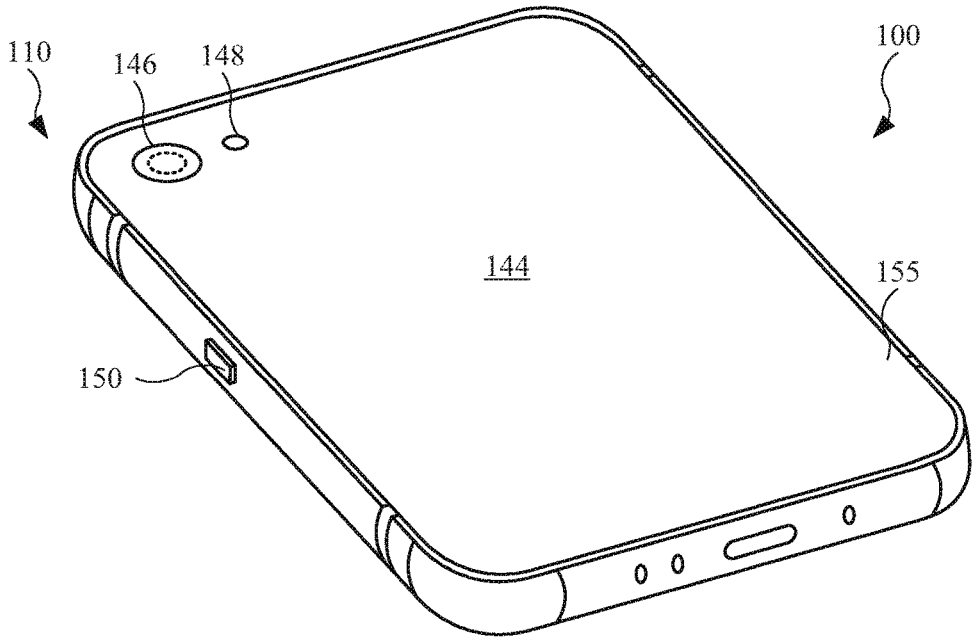
FIG. 2 illustrates a rear isometric view of the electronic device shown in FIG. 1, further showing additional features of the electronic device.

FIG. 2 illustrates a rear isometric view of the electronic device 100 shown in FIG. 1, further showing additional features of the electronic device 100. As shown, the electronic device 100 may include a second protective layer 144 secured with the band 110. The second protective layer 144 may combine with the band 110 to define an enclosure 155 that includes an internal cavity that receives several internal components, such as circuit boards, integrated circuits, internal power supply, as non-limiting examples. In this regard, the band 110 may include a first edge region (shown in FIG. 1) that receives the first protective layer 104, as well as a second edge region that receives the second protective layer 144, with the first edge region and the second edge regions in opposite, or opposing, locations of the band 110.

The second protective layer 144 may include materials, such as glass, sapphire, or plastic. Generally, the second protective layer 144 may include any material (or materials) that provides a rigid support, while also allowing radio frequency ("RF") communication, generated from internal radio circuits (not shown) of the electronic device 100, to permeate through the material(s) of the second protective layer 144. In this manner, the electronic device 100 may be in wireless communication with other devices (not shown) by way of RF communication that is substantially uninhibited by the second protective layer 144.

Also, the second protective layer 144 may include openings that facilitate user interaction with the electronic device 100. For example, the second protective layer 144 may include a first opening 146 and a second opening 148. The electronic device 100 may include an image capture device (not shown) that captures an image (or images) through the first opening 146. The electronic device 100 may further include flash module (not shown) located near the second opening 148, with the flash module generating light energy during an image capture event from the image capture device in order to enhance image quality of the image taken by the image capture device.

The electronic device 100 may further include a second button 150 designed to generate an input when depressed. The input may generate an electrical signal received by a processor circuit (not shown) in the electronic device 100, in order to alter the visual information presented on the display assembly 102. As shown, the second button 150 is located along the fourth part 118. However, other locations are possible.

Figure 3:
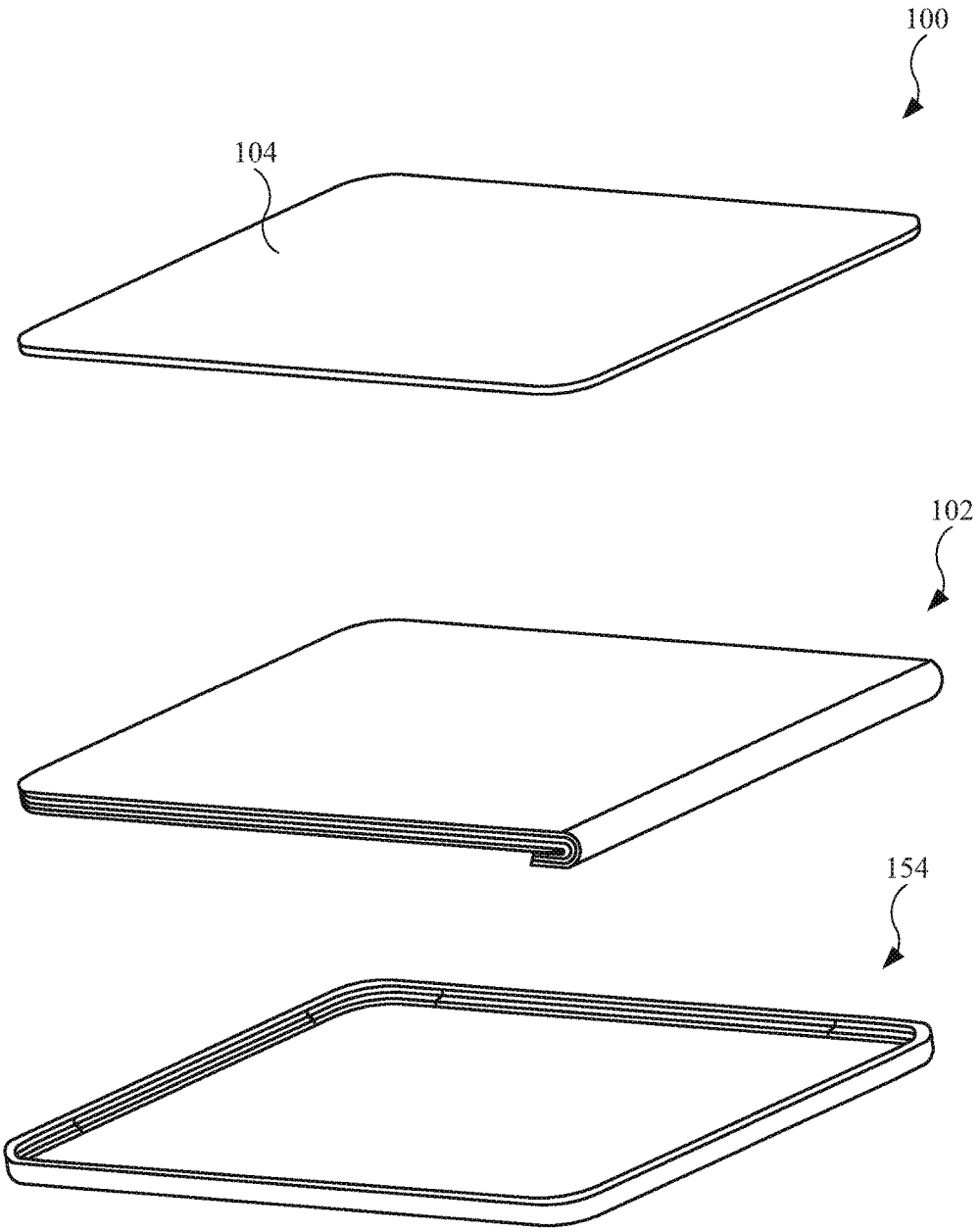
FIG. 3 illustrates a partial exploded view of the electronic device shown in FIG. 1, showing various components of the electronic device.

FIG. 3 illustrates a partial exploded view of the electronic device 100 shown in FIG. 1, showing various components of the electronic device 100. As shown, the first protective layer 104 may overlay the display assembly 102. Also, the first protective layer 104 may adhesively secure with the display assembly 102 by an adhesive layer (not shown). Further, in order to support the first protective layer 104 and facilitate assembly of the first protective layer 104 with the band 110 (shown in FIG. 1), the electronic device 100 may include a frame 154 that secured with the first protective layer 104 by an adhesive layer (not shown). The frame 154 may be positioned at least partially between the first protective layer 104 and the band 110. Accordingly, the frame 154 may include a size and shape in accordance with that of the first protective layer 104. Also, the frame 154 may be formed from a polymeric material, such as plastic, and may also include a metal ring (not shown) that is partially embedded in the polymeric material during an insert molding operation. In this regard, the frame 154 may structurally support the first protective layer 104, as well as one or more components of the display assembly 102. This will be shown below.

Figure 4:
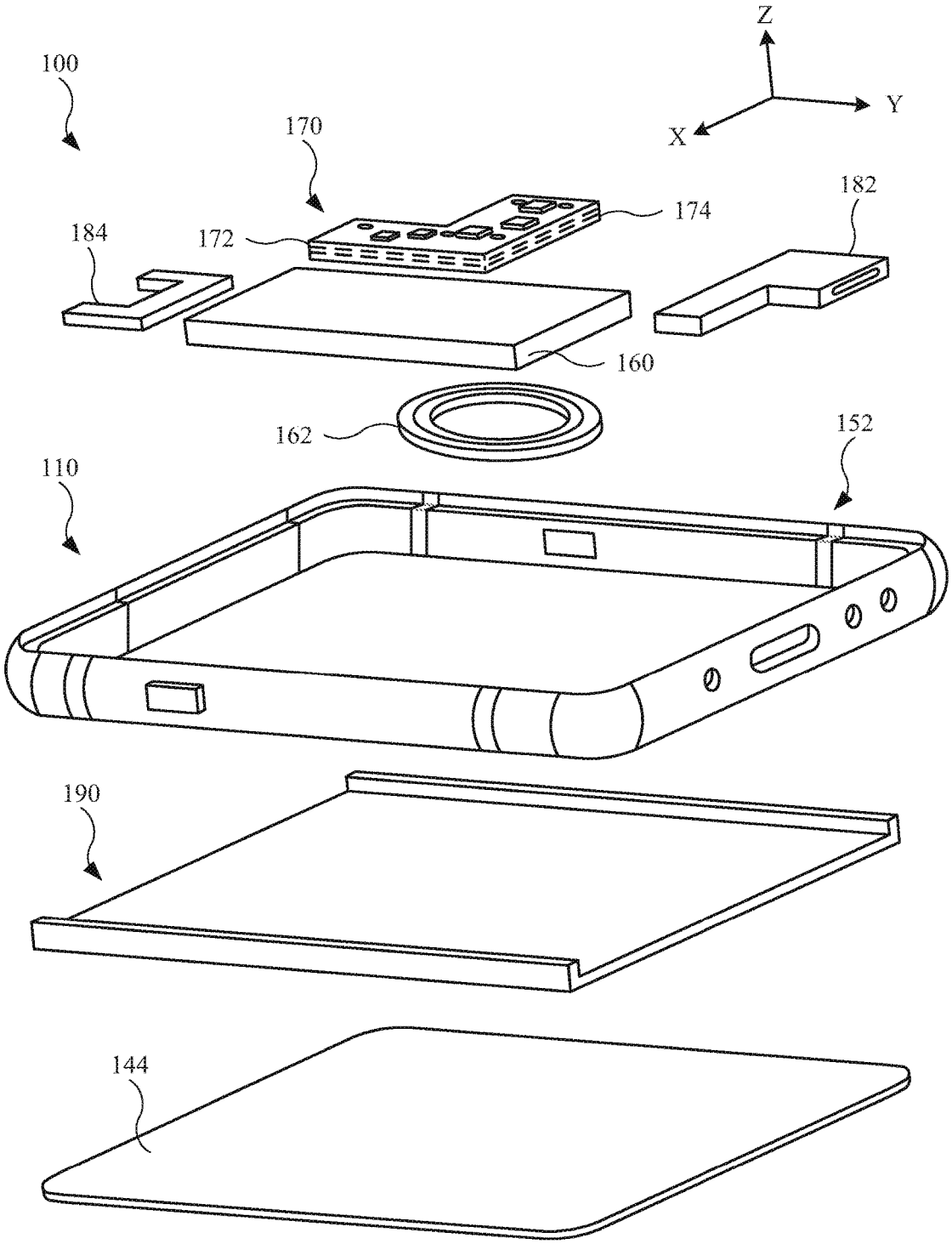
FIG. 4 illustrates a partial exploded view of the electronic device shown in FIG. 1, further showing additional components of the electronic device.

FIG. 4 illustrates a partial exploded view of the electronic device 100 shown in FIG. 1, further showing additional components of the electronic device 100. As shown, the band 110 and the second protective layer 144 may combine to provide an internal volume 152 for several internal components. For example, the electronic device 100 may include an internal power supply 160, or battery, designed to distribute electrical current to operational components of the electronic device 100. The internal power supply 160 may include a rechargeable battery designed to receive electrical current during a recharge. For example, the electronic device 100 may include an inductive receiver coil 162 designed to generate electrical current when exposed to an alternating magnetic field from an external device (not shown). As an alternative charging process to the data port 132 (shown in FIG. 1), the inductive receiver coil 162 can supply the internal power supply 160 with electrical current in order to recharge the internal power supply 160. Also, the non-metal material makeup of the second protective layer 144 allows the external magnetic field to pass through the second protective layer 144 and extend to and around the inductive receiver coil 162.

The electronic device 100 may further include a circuit assembly 170 that includes multiple operational components. As shown, the circuit assembly 170 may include a first circuit board 172 and a second circuit board 174, with the first circuit board 172 stacked over the second circuit board 174. In this manner, the circuit assembly 170 can conserve space, in the x- and y-dimensions, in the internal volume 152. The various features of the circuit assembly 170 will be discussed below.

The electronic device 100 may further include a first audio module 182 and/or a second audio module 184, both of which are designed to generate acoustical energy in the form of audible sound. First and second audio modules 182, 184, respectively, may each include an opening to emit acoustical energy that a user can hear. In some embodiments, at least some of the internal volume of first and second audio modules 182, 184, respectively, is isolated from the internal volume 152 of the electronic device 100. In this manner, when the internal volume 152 changes by, for example, depressing the first protective layer 104 (shown in FIG. 4) to provide a touch input and/or a force input to the electronic device, the audio modules are not affected (acoustically) from the change in the internal volume 152, and associated increased air pressure. This will be discussed in more detail below.

The electronic device 100 may further include a thermal distribution assembly 190. The thermal distribution assembly 190 may include several layers of material. In some embodiments, the layers of material differ. For example, in some embodiments, the thermal distribution assembly 190 includes a first layer formed from a first type material (not labeled) surround by a second layer formed from a second type material (not labeled). The first type material may include a relatively high thermal conductivity, such as copper known to include a thermal conductivity of approximately 400 W/m*K (Watts per meter per Kelvin degree). Alternatively, the first type may include graphite known to include a thermal conductivity of approximately 170 W/m*K. Accordingly, the first type material is well suited to transfer thermal energy from one location to another location. The second type material may include a more robust material, such as stainless steel. The second type material may include a relatively lower thermal conductivity. However, the second type material may provide 1) a protective coating for the first type material, 2) structural support for the electronic device 100, and/or 3) provide workable surface to secure a component (not shown) with the thermal distribution assembly 190 by, for example, a welding operation. The various layers of the thermal distribution assembly 190 will be further described below.

The thermal distribution assembly 190 can be designed to redirect or redistribute heat generated in the electronic device 100. For example, the circuit assembly 170 may include operational components, such as integrated circuits, known to convert electrical energy (supplied by the internal power supply 160) into thermal energy during operation. The thermal distribution assembly 190 can be thermally coupled with the circuit assembly 170 by contact between the thermal distribution assembly 190 and the circuit assembly 170, as a non-limiting example. Also, the thermal distribution assembly 190 may be thermally coupled with the band 110 such that thermal energy received by the thermal distribution assembly 190 from the circuit assembly 170 may at least partially transfer to the band 110, which may also include metal. Accordingly, at least some thermal conductivity lost by using the second protective layer 144 is regained by using the thermal distribution assembly 190. Also, the thermal distribution assembly 190 may include a size and shape in accordance with the second protective layer 144 such that thermal distribution assembly 190 covers, or at least substantially covers, a major (internal) surface of the second protective layer 144.

Although not shown, the electronic device 100 may include additional components, such a haptic engine and internal antennae, as non-limiting examples. Also, although not shown, the electronic device 100 may include several flexible circuits that place the electronic components (e.g., display assembly 102, circuit assembly 170) in electrical communication with one another as well as the internal power supply 160.

Figure 5:
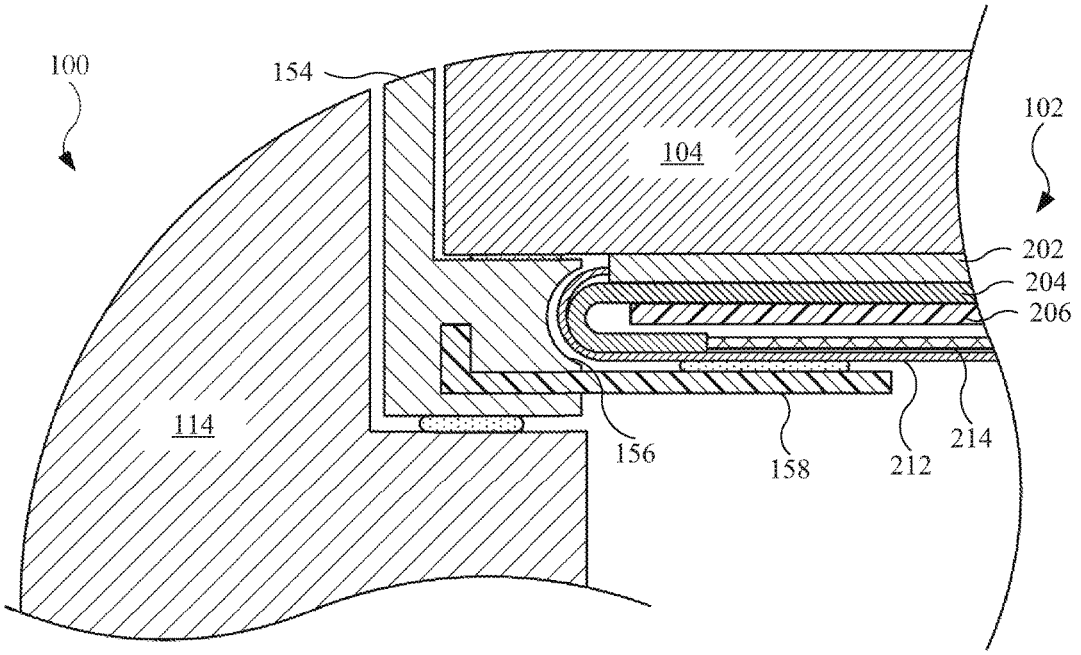
FIG. 5 illustrates a cross sectional view of the electronic device shown in FIG. 1, taken along line A-A in FIG. 1.

FIG. 5 illustrates a cross sectional view of the electronic device 100 shown in FIG. 1, taken along line A-A in FIG. 1. As shown, the display assembly 102 may include a touch sensitive layer 202 designed to receive a touch input, a display layer 204 designed to present visual information, and a force sensitive layer 206 designed to detect an amount of force applied exerted on the display layer 204 by way of exerting a force on at least one of the first protective layer 104, the touch sensitive layer 202, and the display layer 204. Also, although not shown, the display assembly 102 may include adhesive layers to adhesively secure the touch sensitive layer 202 with the display layer 204, and to adhesively secure the display layer 204 with the force sensitive layer 206.

The touch sensitive layer 202 is designed to receive a touch input when, for example, a user (not shown) depresses the first protective layer 104. The touch sensitive layer 202 may include capacitive touch-sensitive technology. For example, the touch sensitive layer 202 may include a layer of capacitive material that holds an electrical charge. In this regard, by touching the screen, the amount of charge changes at a specific point of contact corresponding to a location of the user touch input, for example. The touch input can be relayed from the touch sensitive layer 202 to the circuit assembly 170 (shown in FIG. 4) by a first flexible circuit 212 electrically and mechanically coupled with the touch sensitive layer 202. As shown, the first flexible circuit 212 may bend or curve around the touch sensitive layer 202 and the display layer 204.

In some embodiments, the display layer 204 includes a liquid crystal display ("LCD") that relies upon backlighting to present the visual information. In the embodiment shown in FIG. 5, the display layer 204 includes an organic light emitted diode ("OLED") display. The display layer 204, when including an OLED display, is designed to illuminate (using electrical current from the internal power supply 160) individual pixels, when needed, in order to illuminate display layer 204. When the display layer 204 includes OLED technology, the display layer 204 may include a reduced form factor as compared to an LCD display. In this regard, the display assembly 102 may include a smaller footprint, thereby create more space for other components such as the internal power supply 160 (shown in FIG. 4). Furthermore, when the display layer 204 includes OLED technology, the display layer 204 can curve or bend without causing damage to the display layer 204. For example, as shown in FIG. 5, the display layer 204 includes a 180-degree bend, or approximately 180-degree bend. As shown, the display layer 204 may be bend or curve around the force sensitive layer 206, and electrically and mechanically couple with a second flexible circuit 214 that electrically couples with the circuit assembly 170 (shown in FIG. 4) to place the display layer 204 in communication with the circuit assembly 170. Also, the display layer 204 may include an active matrix organic light emitting diode ("AMOLED") display.

The force sensitive layer 206 may operate by determine an amount of force or pressure is applied to the first protective layer 104, the touch sensitive layer 202, and/or the display layer 204. In this regard, the force sensitive layer 206 may distinguish between different levels of force applied to the electronic device 100 by way of, for example, a force applied to the first protective layer 104. The different levels of force may correspond to different user inputs. The force sensitive layer 206 may include multiple capacitor plates, with one plate of the capacitor plate pairs having an electrical charge. When a force to the electronic device 100, the distance between one least one pair of capacitor plates changes, causing a change in capacitance. The amount of change in capacitance corresponds to an amount of force exerted on the electronic device 100.

The frame 154 may include design considerations that accommodate for the display assembly 102. For example, the frame 154 may include a notch 156, or undercut region, designed to at least partially receive the first flexible circuit 212 and/or the display layer 204. As shown in FIG. 5, the notch 156 includes a size and shape to receive both a bent region of the display layer 204 as well the first flexible circuit 212 in a portion (of the first flexible circuit 212) that is curved or bent. While the notch 156 includes a curvature generally corresponding to that of the first flexible circuit 212 and the display layer 204, other shapes, including straight edges, are possible for the notch 156. Also, the notch 156 may be formed during a molding operation of the frame 154. Alternatively, the notch 156 may be formed subsequent to a molding operation by, for example, a cutting operation.

Also, the frame 154 is adhesively secured with the first protective layer 104 and the second part 114 (of the band 110, shown in FIG. 1) by adhesive layers (not labeled). The frame 154 may include a ring 158 partially embedded in the frame 154. In some embodiments, the ring 158 includes a metal ring that may include a continuous metal. However, the ring 158 may also be discontinuous, and accordingly, may be selectively embedded in the frame 154. As shown, the ring 158 may extend along the frame 154 to support the display assembly 102 and the first protective layer 104. Also, the first flexible circuit 212 may adhesively secure with the ring 158 by an adhesive layer (not shown).

FIG. 5 further shows the some components of the display assembly 102 are coupled with the flexible circuits at one location while other components are not. For example, the touch sensitive layer 202 and the display layer 204 are electrically and mechanically coupled with the first flexible circuit 212 and the second flexible circuit 214, respectively, at a location proximate to the second part 114 (defined by a U-shape configuration), while the force sensitive layer 206 is not. Alternatively, the touch sensitive layer 202 and the display layer 204 are electrically and mechanically coupled with the first flexible circuit 212 and the second flexible circuit 214, respectively, at a location proximate to the notch 156 in the frame 154, while the force sensitive layer 206 is not. The electrical and mechanical coupling between the force sensitive layer 206 and a flexible circuit will be shown below.

Figure 6:
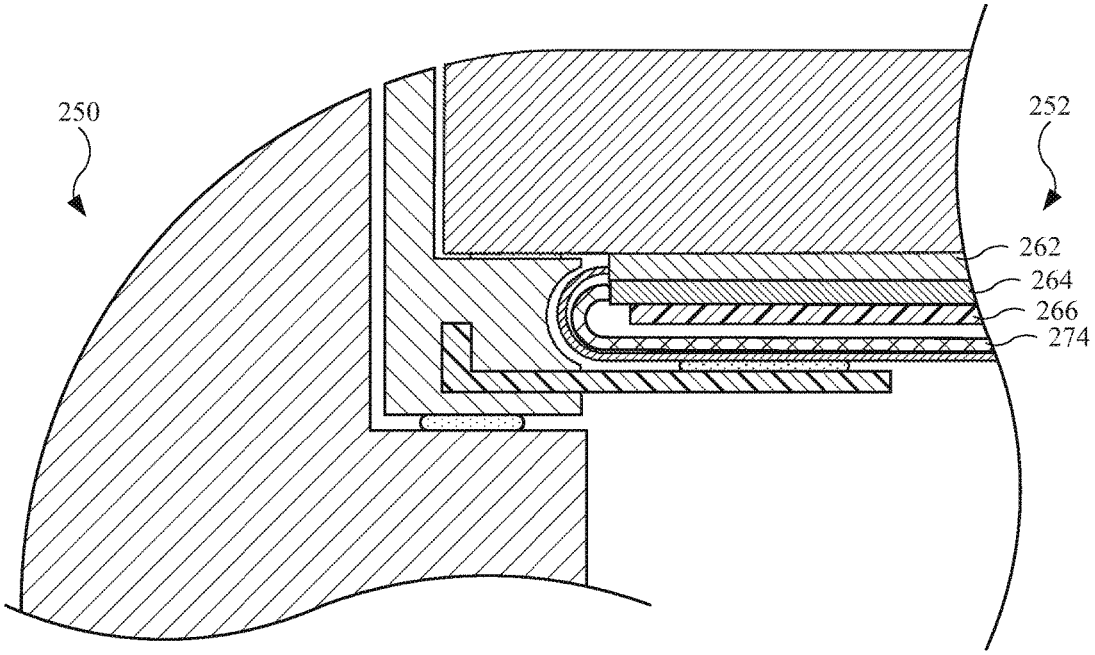
FIG. 6 illustrates a cross sectional view of an alternate embodiment of an electronic device, in accordance with some described embodiments.

FIG. 6 illustrates a cross sectional view of an alternate embodiment of an electronic device 250, in accordance with some described embodiments. The electronic device 250 may include any feature or component previously described for an electronic device. For example, the electronic device 250 may include a display assembly 252 that includes a touch sensitive layer 262, a display 264, and a force sensitive layer 266. However, as shown in FIG. 6, the display 264 may include a substantially flat configuration throughout the display 264, with a flexible circuit 274 bending around the force sensitive layer 266 to electrically and mechanically couple with the display 264.

Figure 7:
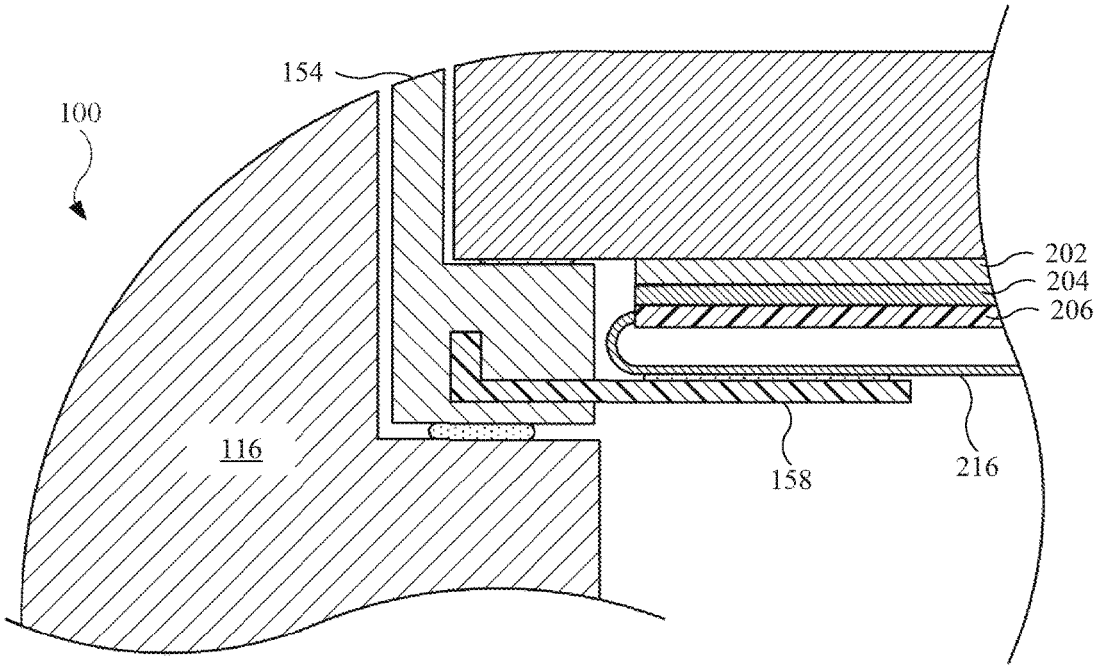
FIG. 7 illustrates a cross sectional view of the electronic device shown in FIG. 1, taken along line B-B in FIG. 1.

FIG. 7 illustrates a cross sectional view of the electronic device 100 shown in FIG. 1, taken along line B-B in FIG. 1. As shown, the force sensitive layer 206 is electrically and mechanically coupled with a third flexible circuit 216 that electrically couples with the circuit assembly 170 (shown in FIG. 4) to place the force sensitive layer 206 in communication with the circuit assembly 170. Also, the third flexible circuit 216 may adhesively secure with the ring 158 by an adhesive layer (not labeled).

As shown in FIG. 7, only the force sensitive layer 206 includes an electrical and mechanical connection with a flexible circuit. In other words, the electrical and mechanical connection between the force sensitive layer 206 and the third flexible circuit 216 is in a different location of the electronic device 100, as compared to the electrical and mechanical connections between the touch sensitive layer 202 and the first flexible circuit 212 (shown in FIG. 5), and the electrical and mechanical connections between the display layer 204 and the second flexible circuit 214 (shown in FIG. 5). Further, the electrical and mechanical connection between the force sensitive layer 206 and the third flexible circuit 216 is proximate to the third part 116, which is defines in part a sidewall that is perpendicular, or approximately, perpendicular to a sidewall defined by the second part 114 (shown in FIG. 5). As a result, the frame 154 may not require a notch 156, or undercut, shown in FIG. 5, to accommodate the display layer 204 and the first flexible circuit 212 (shown in FIG. 5). The additional material of the frame 154 may allow for additional structural rigidity of the frame 154.

Figure 8:
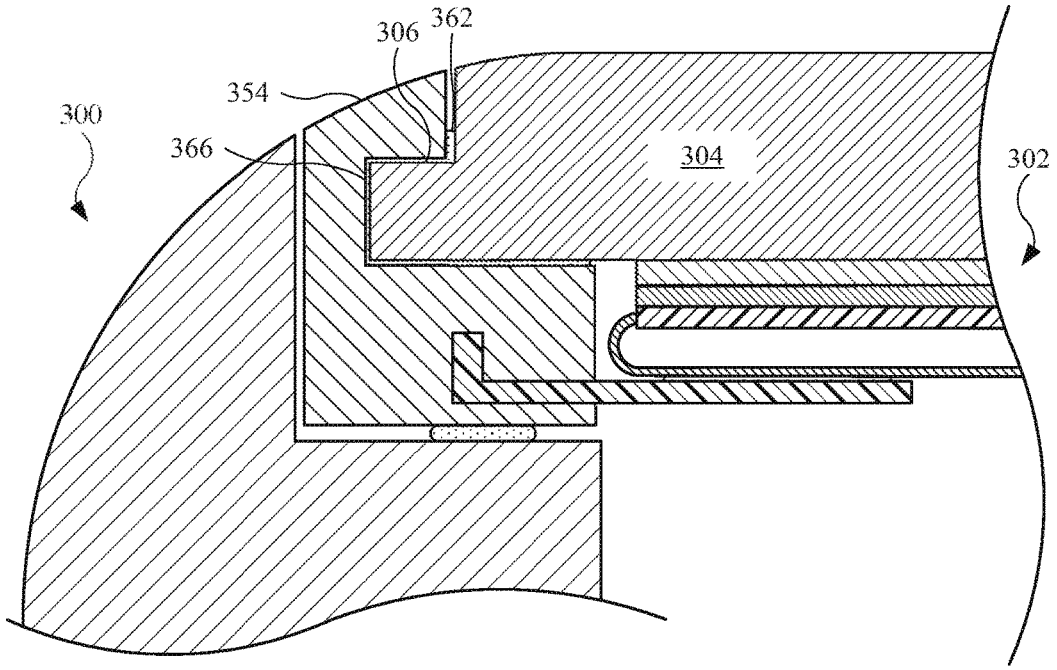
FIG. 8 illustrates a cross sectional view of an alternate embodiment of an electronic device, in accordance with some described embodiments.

FIG. 8 illustrates a cross sectional view of an alternate embodiment of an electronic device 300, in accordance with some described embodiments. The electronic device 300 may include any feature or component previously described for an electronic device. For example, the electronic device 300 may include a first protective layer 304 secured with a display assembly 302, and a frame 354 that carries the first protective layer 304. However, the first protective layer 304 may include an extension 306 that at least partially surrounds the first protective layer 304 in a circumferential manner. In order to accommodate the extension 306, the frame 354 may include a notch 366 that receives the extension 306. The extension 306 provides the first protective layer 304 with an additional profile to which the first protective layer 304 adhesively bonds with the frame 354. For example, as shown in FIG. 8, the first protective layer 304 is adhesively secured with the frame 354 by an adhesive layer 362 that extends through a region defined in part by an interface region between the frame 354 and the first protective layer 304, including the extension 306. Also, the distance or gap between the frame 354 and the first protective layer 304 (including the extension 306) may cause the adhesive layer 362 to extend through the interface region by capillary forces. As a result, the frame 354 is adhesively secured with the first protective layer 304 by multiple (perpendicular) surfaces in order to form a stronger adhesive bond.

Figure 9:
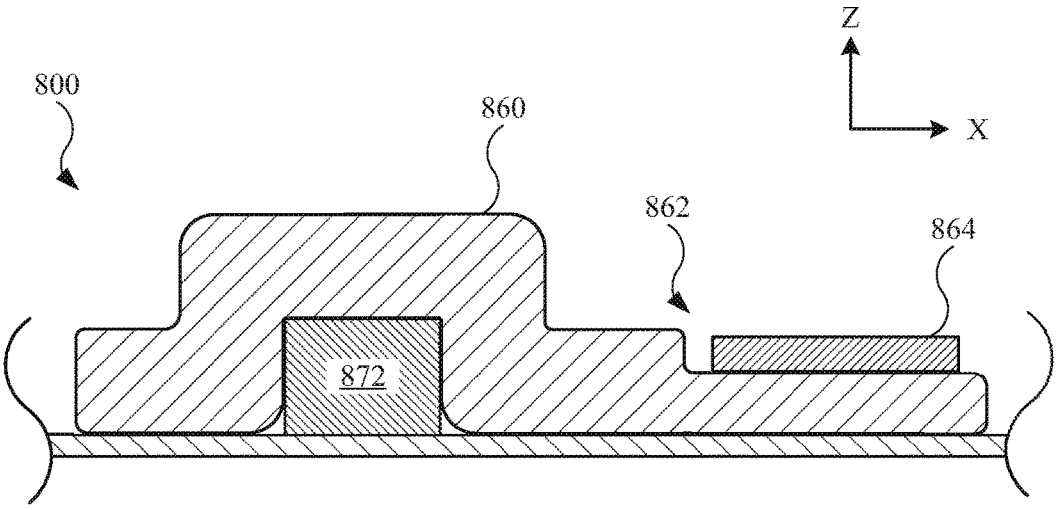
FIG. 9 illustrates a cross sectional view of an electronic device in accordance with some described embodiments.

FIG. 9 illustrates a cross sectional view of an alternate embodiment of an electronic device 800, in accordance with some described embodiments. As shown, the internal power supply 860 may pass over the first internal component 872, while also having a channel 862 that includes a size and shape to receive the flexible circuit 864. Although not shown, the channel 862 may include a size and shape to receive two or more flexible circuits in order to electrically couple additional internal components (not shown) with a circuit assembly. Also, the channel 862 may include a size and shape such that the flexible circuit 864 (or additional flexible circuits) does/do not extend behind the internal power supply 860 in the z-dimension.

Figure 10:
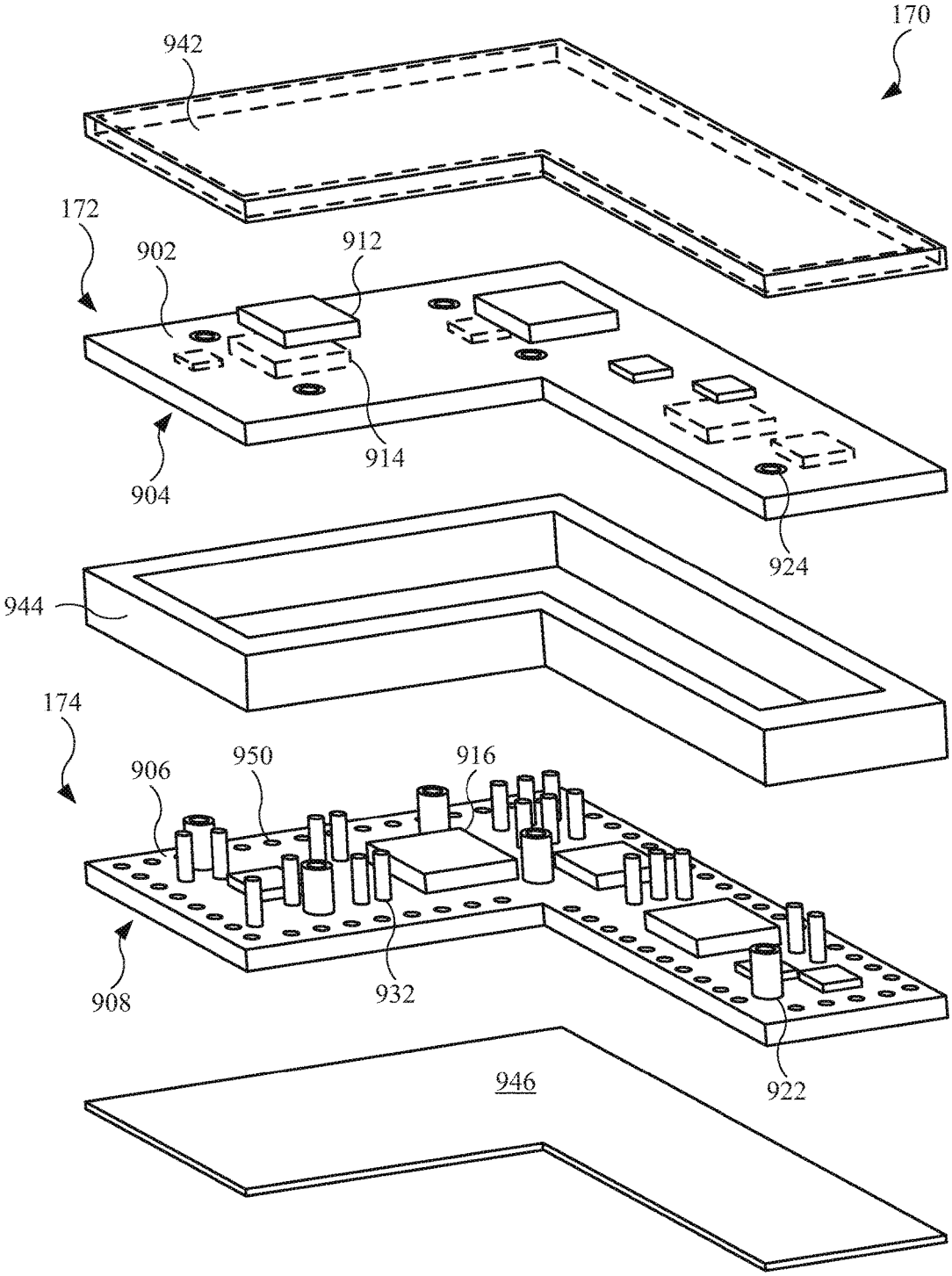
FIG. 10 illustrates an exploded view of the circuit assembly, in accordance with some described embodiments.

FIG. 10 illustrates an exploded view of the circuit assembly 170, in accordance with some described embodiments. As shown, the circuit assembly 170 may include a first circuit board 172 and a second circuit board 174. In some embodiments, the first circuit board 172 and the second circuit board 174 each include a printed circuit board. Also, in order to conserve space in the electronic device 100 (shown in FIG. 1), the first circuit board 172 may be secured with, and positioned over, the second circuit board 174 in a stacked configuration. The additional space provided by stacking the circuit boards may provide additional space in the electronic device 100 for other components, such as the internal power supply 160 (shown in FIG. 4). Also, the additional space provided by the display layer 204 (shown in FIG. 5) may allow for the stacked configuration of the circuit boards. Moreover, in some embodiments (not shown), the circuit assembly 170 includes three or more circuit boards in a stacked configuration.

The first circuit board 172 and/or the second circuit board 174 may include several operational components, including integrated circuits (processor circuits, memory circuits) and transistors, as non-limiting examples. Furthermore, the circuit boards may include operational components on multiple surfaces. For example, the first circuit board 172 may include a first surface 902 and a second surface 904 opposite the first surface 902, with the first surface 902 having a first operational component 912 and the second surface having a second operational component 914 (shown as a dotted line). As shown in FIG. 10, both the first surface 902 and the second surface 904 may include additional operational components. Also, it should be noted that the operational components on the first circuit board 172 are in electrical communication with each other. The communication means may include, for example, at least one via extending through the first circuit board 172.

The second circuit board 174 may include a first surface 906 that includes several operational components, such as an operational component 916. The second circuit board 174 also includes a second surface 908 opposite the first surface 906. In some embodiments, the second surface 908 includes operational components in electrical communication with the operational components located on the first surface 906.

The first circuit board 172 may mechanically connect with the second circuit board 174 by several standoffs connected with rivets. For example, as shown in FIG. 10, the second circuit board 174 includes a first standoff 922 designed to connect with a first rivet 924 located on the first circuit board 172. The remaining standoffs and rivets (not labeled) may connect with one another. The standoffs may maintain a desired distance between the first circuit board 172 and the second circuit board 174 such that components on the second surface 904 of the first circuit board 172 do not interfere with components on the first surface 906 of the second circuit board 174, and vice versa. Also, the positioning of the standoffs and the rivets may be reversed such that the first circuit board 172 includes the standoffs and the second circuit board 174 includes the rivets.

Figure 12:
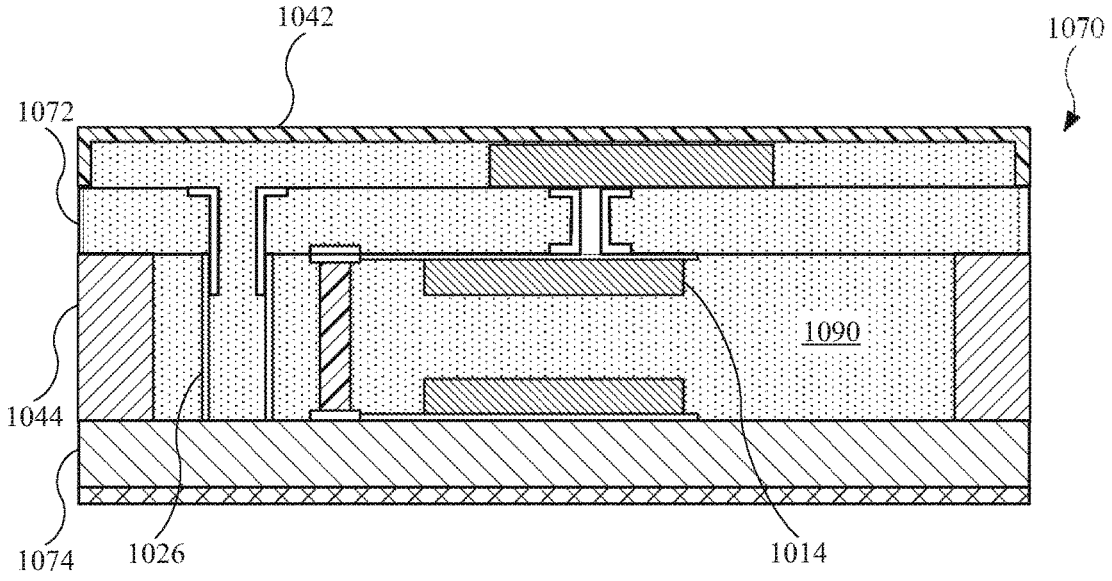
FIG. 12 illustrates an alternative embodiment of a circuit assembly, showing the circuit assembly modified for ingress protection.

In order to electrically couple the first circuit board 172 with the second circuit board 174, several interposers may be used to route electrical signals between the first circuit board 172 and the second circuit board 174. For example, as shown in FIG. 12, the second circuit board 174 may include several interposers, such as an interposer 932, electrically with the second circuit board 174 by a soldering operation. Several additional interposers (not labeled) are shown. Also, although not shown, the second circuit board 174 may include several metal traces that electrically couple the interposers with one or more operational components on the second circuit board 174. Also, each of the interposers may electrically couple with one or more metal traces (not shown) on the second surface 904 of the first circuit board 172.

The circuit assembly 170 may include several shielding features that may shield the components of the circuit assembly 170 from electromagnetic interference ("EMI"), and also may shield components of the electronic device 100 (shown in FIG. 1) that are external to the circuit assembly 170 from EMI generated by one or more components of the circuit assembly 170. For example, the circuit assembly 170 may include a first shielding element 942 that covers components located on the first surface 902 of the first circuit board 172. The first shielding element 942 may include a metal-based material designed to form an EMI shield.

The circuit assembly 170 may further include a second shielding element 944 designed to an EMI shield for operational components located on the second surface 904 of the first circuit board 172 and the first surface 906 of the second circuit board 174. The second shielding element 944 may include a metal, such as copper or brass. The second shielding element 944 may secure with the first circuit board 172 and the second circuit board 174 by several solder joints disposed on each board. For example, FIG. 12 shows the second circuit board 174 having several solder joints, such as a first solder joint 950, positioned around an outer perimeter of the second circuit board 174. The first circuit board 172 may also include solder joints (not shown) in locations corresponding to the solder joints on the second circuit board 174. In some embodiments, the second shielding element 944 includes several discontinuous structural elements. In the embodiment shown in FIG. 10, the second shielding element 944 includes a continuous structural component designed to extend around an outer perimeter of the circuit assembly 170.

Also, the circuit assembly 170 may further include a third shielding element 946 positioned on the second surface 908 of the second circuit board 174. The third shielding element 946 may include metal traces throughout the second surface 908. In addition to forming an EMI shield, the third shielding element 946 may define at least part of an electrical ground path for the circuit assembly 170.

Figure 11:
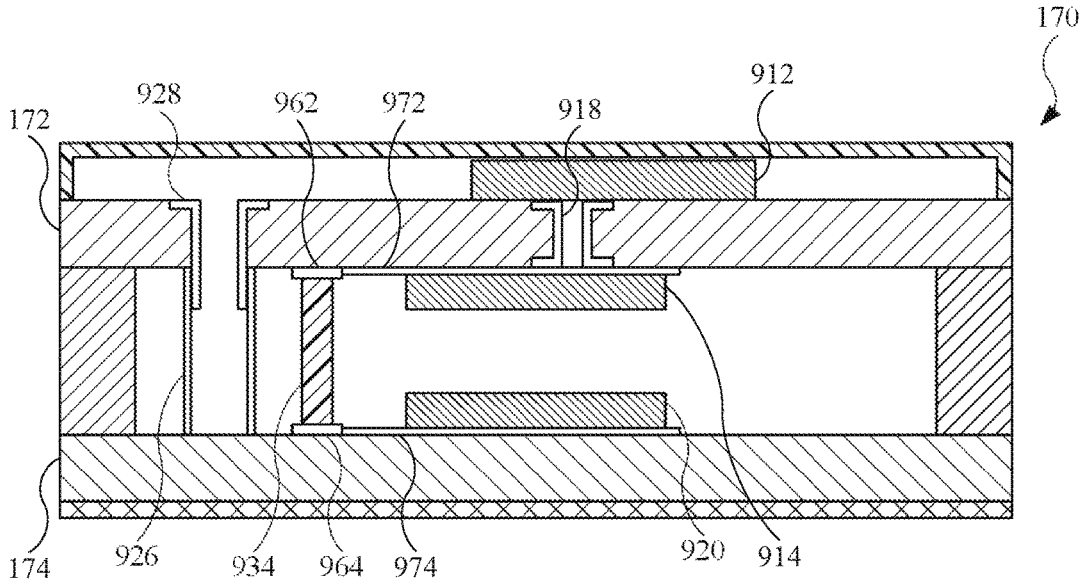
FIG. 11 illustrates a cross sectional view of the circuit assembly shown in FIG. 10, showing various internal components of the circuit assembly.

FIG. 11 illustrates a cross sectional view of the circuit assembly 170 shown in FIG. 10, showing various internal components of the circuit assembly 170. As shown, the first circuit board 172 may be separated from the second circuit board 174 by a standoff 926. Further, in order to mechanically couple the first circuit board 172 with the second circuit board 174, the standoff 926 can be mechanically coupled with the a rivet 928.

The first circuit board 172 may include a via 918 formed from a metal to provide an electrical connect between the first operational component 912 and the second operational component 914. Also, the first circuit by 172 may be in electrical communication with the second circuit board 174 by way of an interposer 934. As shown, the interposer 934 may electrically and mechanically connect with a first solder joint 962 located on the first circuit board 172, and may also electrically and mechanically connect with a second solder joint 964 located on the second circuit board 174. In addition to the interposer 934, several additional interposers (not shown) may be used to carry signals between the circuit boards. The first circuit board 172 may include a first metal trace 972 electrically connected with the second operational component 914 as well as the via 918, and the second circuit board 174 may include a first metal trace 974 electrically connected with a third operational component 920 located on the second circuit board 174. In this manner, the third operational component 920 may electrically communicate with the second operational component 914 and/or the third operational component 920. The circuit assembly 170 may use several additional metal traces, operational components, and solder joints to provide additional electrical communication pathways.

FIG. 12 illustrates an alternative embodiment of a circuit assembly 1070, showing the circuit assembly 1070 modified for ingress protection. The circuit assembly 1070 may include any components and features previously described for a circuit assembly. However, as shown in FIG. 12, the circuit assembly 1070 may include a potting material 1090 positioned between a first circuit board 1072 and a second circuit board 1074 of the circuit assembly 1070. The potting material 1090 may include resin that cures to form a water-resistant material for the various operational components of the circuit assembly 1070. In this regard, the potting material 1090 may prevent damage to the circuit assembly 1070, and in particular to an operational component 1014, otherwise caused by liquid ingress. Further, the potting material 1090 may extend to a first shielding element 1042 and a second shielding element 1044 of the circuit assembly 1070, in order to prevent corrosion to components, such as a standoff 1026. Although not shown, the potting material 1090 may be applied to the circuit assembly 170 (shown in FIG. 11).

Figure 13:
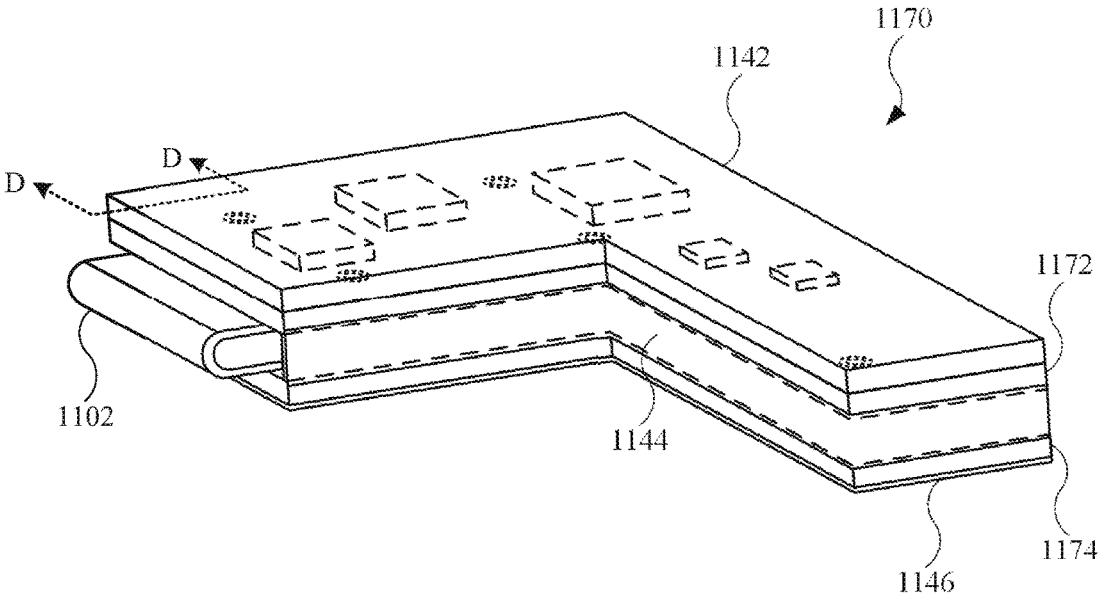
FIG. 13 illustrates an alternate embodiment of a circuit assembly, showing the circuit assembly having a flexible circuit electrically coupled with the circuit boards of the circuit assembly, in accordance with some described embodiments.

FIG. 13 illustrates an alternate embodiment of a circuit assembly 1170, showing the circuit assembly 1170 having a flexible circuit 1102 electrically coupled with the circuit boards of the circuit assembly, in accordance with some described embodiments. The circuit assembly 1170 may include any components and/or features previously described for a circuit assembly. For example, as shown, the circuit assembly 1170 may include a first circuit board 1172 and a second circuit board 1174. The circuit assembly 1170 may further include a first shielding element 1142 disposed over the first circuit board 1172 and at least some of its components. The circuit assembly 1170 may further include a second shielding element 1144 covering a gap between the first circuit board 1172 and the second circuit board 1174. The circuit assembly 1170 may further include a third shielding element 1146 disposed over the second circuit board 1174. However, rather than using interposers for electrical communication, the circuit assembly 1170 relies upon the flexible circuit 1102 in communication with both the first circuit board 1172 and the second circuit board 1174.

The flexible circuit 1102 may electrically and mechanically couple with the first circuit board 1172 and the second circuit board 1174 by a hot bar soldering operation. A thermode (not shown) may be used as a "hot bar" that is heated in order to supply thermal energy to the flexible circuit 1102 and to soldering elements (not shown), resulting in an electro-mechanical connection. It should be noted that multiple hot bar soldering operations may be used to couple the flexible circuit 1102 with the first circuit board 1172 and the second circuit board 1174.

Figure 14:
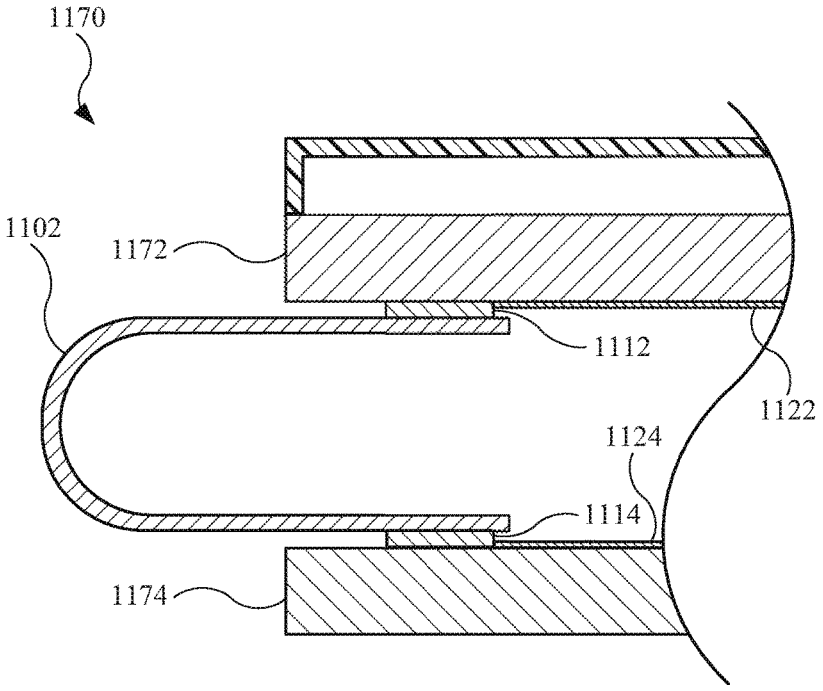
FIG. 14 illustrates a cross sectional view of the circuit assembly shown in FIG. 13, showing the flexible circuit extending between the circuit boards.

FIG. 14 illustrates a cross sectional view of the circuit assembly 1170 shown in FIG. 13, taken along line D-D, showing the flexible circuit 1102 extending between the circuit boards. As shown, the flexible circuit 1102 may electromechanically couple with a first solder joint 1112 and a second solder joint 1114, located on the first circuit board 1172 and the second circuit board 1174, respectively. Also, the first solder joint 1112 may electrically couple with a first metal trace 1122 on the first circuit board 1172, and the second solder joint 1114 may electrically couple with a second metal trace 1124 on the second circuit board 1174. In this regard, the flexible circuit 1102 may electrically couple with several operational components (not shown), some of which are electrically coupled with the first metal trace 1122 and some of which are electrically coupled with the second metal trace 1124.

Figure 15:
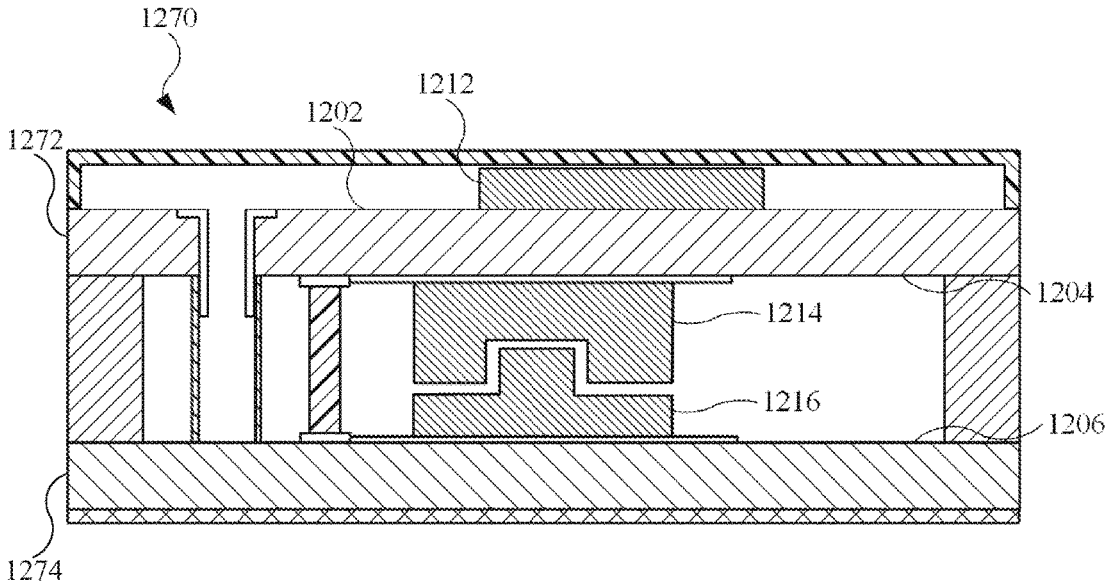
FIG. 15 illustrates a cross sectional view of an alternate embodiment of a circuit assembly, showing internal components of the circuit assembly having corresponding geometries, in accordance with some described embodiments.

FIG. 15 illustrates a cross sectional view of an alternate embodiment of a circuit assembly 1270, showing internal components of the circuit assembly 1270 having corresponding geometries, in accordance with some described embodiments. The circuit assembly 1270 may include any components and/or features previously described for a circuit assembly. For example, the circuit assembly 1270 may include a first circuit board 1272 and a second circuit board 1274. The first circuit board 1272 may include a first surface 1202 having a first operational component 1212 and a second surface 1204 (opposite the first surface 1202) having a second operational component 1214. Further, the second circuit board 1274 may include a third operational component 1216 located on a first surface 1206 of the second circuit board 1274.

However, the second operational component 1214 and the third operational component 1216 may be in a nested configuration. For example, as shown in FIG. 15, the third operational component 1216 may at least partially extend into a recess of the second operational component 1214. This may allow for a reduce dimension of the circuit assembly 1270, thereby reducing the overall space occupied by the circuit assembly 1270 in an electronic device (not shown).

Figure 16:
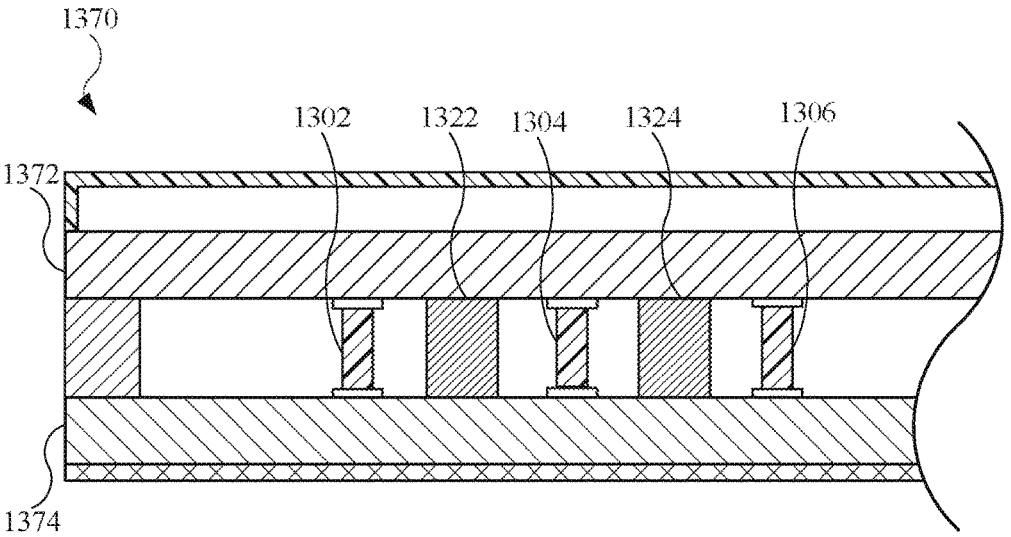
FIG. 16 illustrates a cross sectional view of an alternate embodiment of a circuit assembly, showing the circuit assembly having several solder masks used to support a circuit board, an accordance with some described embodiments.

FIG. 16 illustrates a cross sectional view of an alternate embodiment of a circuit assembly, showing the circuit assembly having several solder masks used to support a circuit board, an accordance with some described embodiments. The circuit assembly 1370 may include any components and/or features previously described for a circuit assembly. For example, the circuit assembly 1370 may include a first circuit board 1372 and a second circuit board 1374. Further, the first circuit board 1372 and the second circuit board 1374 may include several solder joints (not labeled), with an interposer electrically coupled with a solder joint from the first circuit board 1372 and with a solder joint from the second circuit board 1374.

In order to prevent oxidation of the solder joints and/or to prevent solder "bridges" from forming between adjacent solder joints during a soldering operation, the circuit assembly 1370 may include several soldering masks. For example, the circuit assembly 1370 may include a first solder mask 1322 between a first interposer 1302 and a second interposer 1304, and a second solder mask 1324 between the second interposer 1304 and a third interposer 1306. Based on their positions, the first solder mask 1322 may prevent a solder bridge between the first interposer 1302 and the second interposer 1304, and the second solder mask 1324 may prevent a solder bridge between the second interposer 1304 and the third interposer 1306. Moreover, the first solder mask 1322 and the second solder mask 1324 may provide a support structure, in places of bosses (previously described), that maintain a desired distance or separate between the first circuit board 1372 and the second circuit board 1374. Further, the first circuit board 1372 may clamp onto the first solder mask 1322 and the second solder mask 1324, and the first circuit board 1372 is maintained with the second circuit board 1374. The interposers, solder joints, and solder masks may be representative of several additional interposers, solder joints, and solder masks, respectively.

Audio Module

Figure 17A:
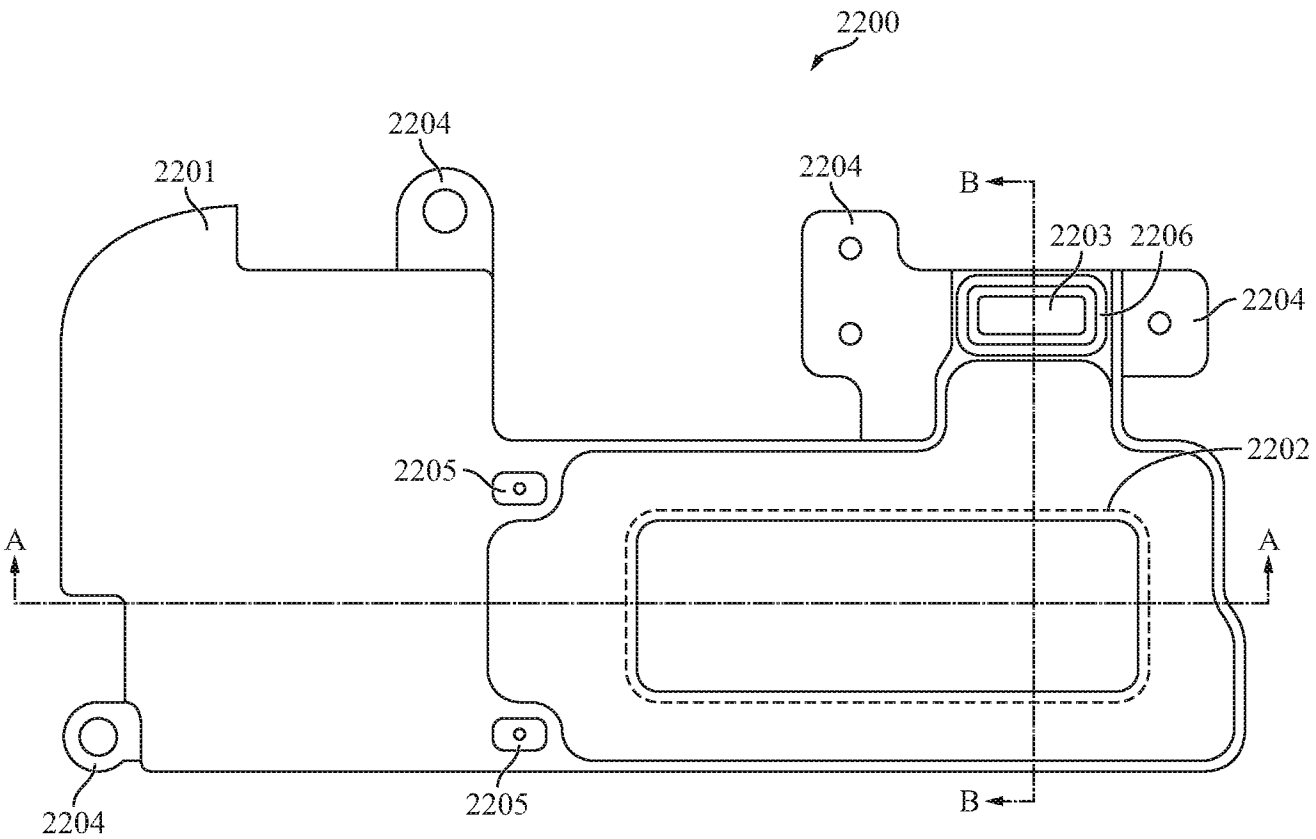
FIG. 17A illustrates a top plan view of an embodiment of an audio module, in accordance with embodiments described herein.

FIG. 17A illustrates a top plan view of an embodiment of an audio module 2200, in accordance with some embodiments described herein. Audio module 2200 can be representative of first audio module 182 (shown in FIG. 4) and/or second audio module 184 employed in electronic device 100. More specifically, in some embodiments audio module 2200 can be used as a receiver module designed to generate audible sound for a receiver portion of a cellular telephone such as electronic device 100 (see FIG. 1) and can include features for fitting within a low profile electronic device.

For example, some embodiments of the disclosure pertain to an audio module for an electronic device that is not affected by pressure fluctuations within the electronic device that could be caused, for example, by pressure against a touch screen of the electronic device. More specifically, when a force is applied to the touch screen the touch screen deflects causing an internal volume of the electronic device to be momentarily reduced which in turn results in an increase of the air pressure within the electronic device. Since the audio module is located within the electronic device it is subjected to the increase in air pressure. To protect the audio module from altering its acoustic output in response to the momentary increase in air pressure the audio module can include a completely sealed enclosure that has a sound port that is sealed to the enclosure of the electronic device so the only opening the audio module has is to the external environment outside of the electronic device.

Further embodiments can include features that enable the audio module to be positioned within an electronic device having a relatively thin profile. In some embodiments a portion of the back volume of the acoustic module can be positioned in front of the speaker plane to more effectively utilize available space within the electronic device. Various embodiments can include a U-shaped channel that enables the sound port of the acoustic module to be positioned away from the diaphragm. More specifically, the U-shaped channel can function as a sound channel that enables acoustic energy generated by the driver assembly to be ported to a location remote from the driver assembly and out of the electronic device enclosure. A resonant cavity can be positioned within a portion of the back volume, but separated from the back volume, and employed to compensate for any negative effects on the acoustic performance due to the U-shaped channel. Further details of audio module and its various features for enhanced audio performed are described in more detail below.

As shown in FIG. 17A, audio module 2200 includes an enclosure 2201 surrounding a driver assembly 2202 (hidden in FIG. 17A) coupled to a sound port 2203. Sound port 2203 can be equipped with one or more gaskets 2206 to seal enclosure 2201 to a housing of an electronic device within which the audio module is located such that audible sound can be generated by driver assembly 2202 and heard outside of the electronic device. For example, audio module 2200 can be secured within electronic device 100 (see FIG. 1) and sound port 2203 can be sealed to enclosure 155 (see FIG. 2) such that audible sound can be discharged from second opening 108 and heard by a user. As further illustrated in FIG. 17A, enclosure 2201 can include one or more mounting tabs 2204 for securing audio module 2200 to an electronic device, and a plurality of electrical connections 2205 for coupling audio signals to driver assembly 2202.

Figure 17B:
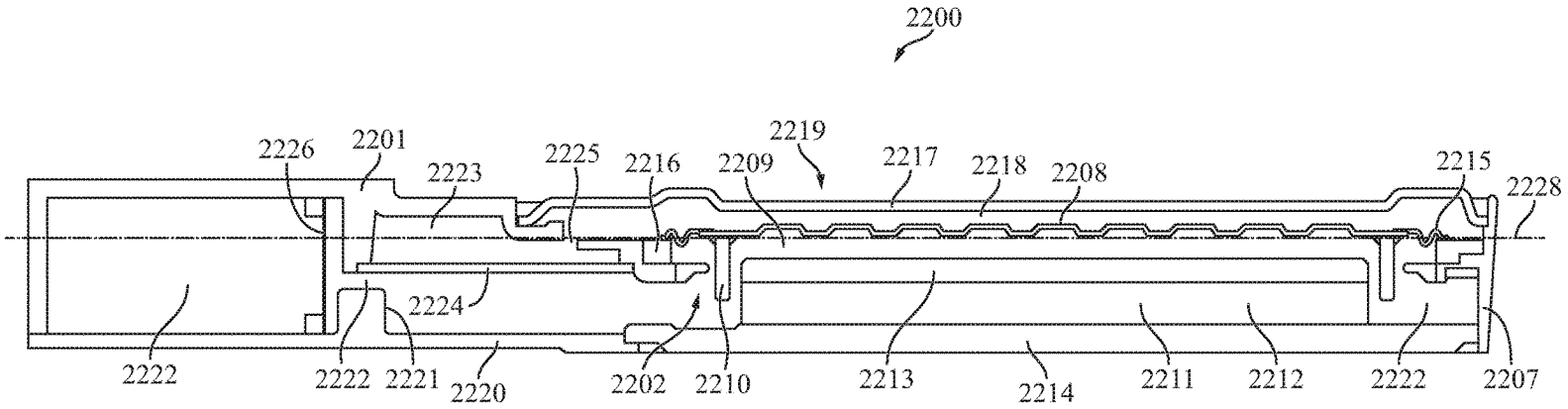
FIG. 17B illustrates cross-sectional view A-A of the audio module illustrated in FIG. 17A.

FIG. 17B illustrates cross-sectional view A-A of audio module 2200 illustrated in FIG. 17A. As shown in FIG. 17B, audio module 2200 includes enclosure 2201 that includes a frame 2207 and a plurality of covers that are attached to the frame, as described in more detail below. Driver assembly 2202 is positioned within enclosure 2201 and includes a diaphragm 2208 positioned within a speaker opening 2209 in frame 2207. Driver assembly 2202 further includes a voice coil 2210 that is attached to diaphragm 2208 and positioned adjacent a magnet assembly 2211. Magnet assembly 2211 includes one or more permanent magnets 2212 positioned between a top flux plate 2213 and a bottom flux plate 2214. Diaphragm 2208 is held in place within speaker opening 2209 by a flexible suspension ring 2215 attached to frame 2207 with a seal 2216.

Voice coil 2210 includes one or more wire windings that are terminated to plurality of electrical connections 2205 (see FIG. 17A). Flexible suspension ring 2215 suspends diaphragm 2208 within speaker opening 2209 and is illustrated in an unbiased neutral position in FIG. 17B such that when a voltage is applied across one or more electrical connections 2205 (see FIG. 17A) a magnetic field is generated within voice coil 2210 and the diaphragm moves up or down within the speaker opening, creating acoustic energy that can be emitted from sound port 2203 (see FIG. 17A).

A front cover 2217 is attached to frame 2207 and is positioned parallel to and spaced apart from diaphragm 2208. A front volume 2218 for driver assembly 2202 is defined by frame 2207, front cover 2217 and diaphragm 2208 and is positioned substantially in front of a speaker plane 2228. In some embodiments front cover 2217 can include a recessed region 2219 that is formed inward towards diaphragm 2208 to reduce a portion of front volume 2218 directly in front of diaphragm 2208 to reduce the acoustic load on driver assembly 2202 and assist in tuning the high frequency response of audio module 2200. A rear cover 2220 is attached to frame 2207 and is positioned parallel to and spaced apart from diaphragm 2208. In some embodiments a portion of rear cover 2220 includes bottom flux plate 2214.

A back volume 2222 for driver assembly 2202 is defined by frame 2207 and rear cover 2220. A substantial portion of back volume 2222 is positioned to the side of driver assembly 2202 such that a portion of back volume 2222 is in front of speaker plane 2228 (shown on the left side of FIG. 17B) and a portion of the back volume is positioned behind (e.g., on the opposite side of) the speaker plane (shown on the left side of FIG. 17B and elsewhere within the enclosure).

A resonant cavity 2223 is defined by frame 2207 and a resonant cavity cover 2224 that is attached to the frame. Resonant cavity 2223 is coupled to front volume 2218 with a resonant cavity port 2225 and resonant cavity cover 2224 separates the resonant cavity from back volume 2222. In some embodiments resonant cavity 2223 can be configured to function as a Helmholtz resonator that is tuned to resonate at a particular frequency to adjust the frequency response of acoustic module 2200, as discussed in more detail below.

In some embodiments a portion of back volume 2222 is filled with a material to increase the effective size of the back volume. In various embodiments the material can be a zeolite powder. An internal mesh 2226 can be used to restrain the material and/or adjust acoustic performance of the back volume. In various embodiments a neck 2221 can be added to rear cover 2220 and/or frame 2207 to reduce a cross-sectional area of back volume 2222 before it enters a region that is filled with the material.

Figure 17C:
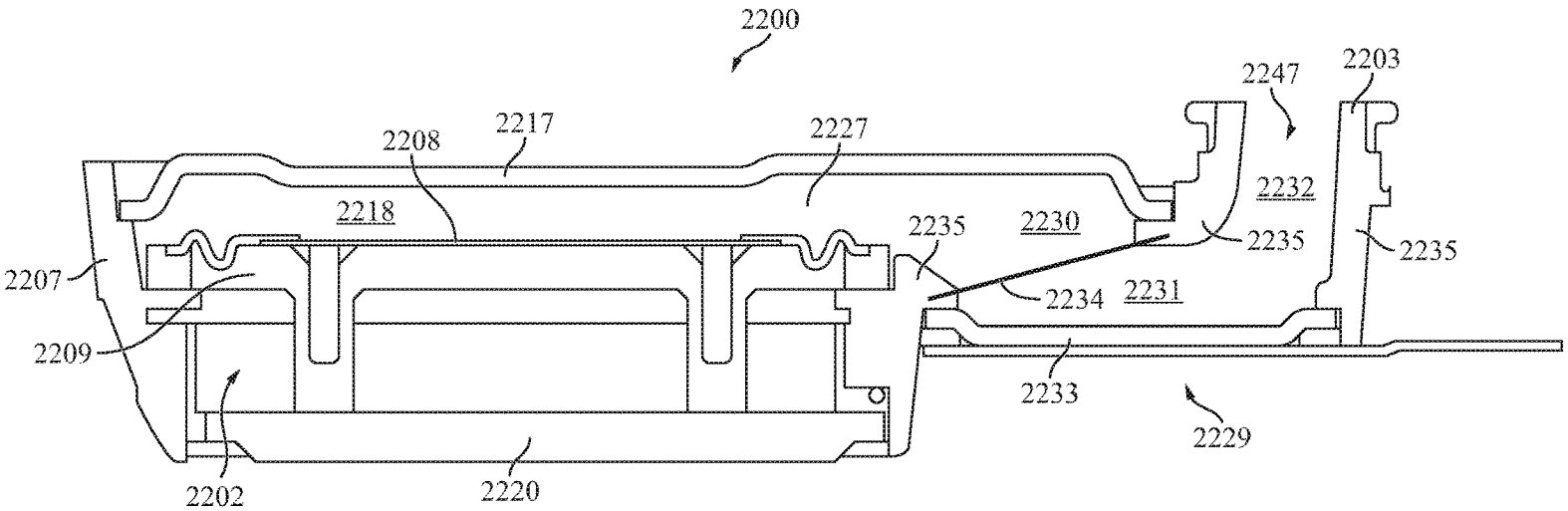
FIG. 17C illustrates cross-sectional view B-B of the audio module illustrated in FIG. 17A.

FIG. 17C illustrates cross-sectional view B-B of audio module 2200 illustrated in FIG. 17A. As shown in FIG. 17C, audio module 2200 includes a front volume aperture 2227 positioned transverse to diaphragm 2208 such that sound from the diaphragm exits front volume 2218 in a direction parallel to the diaphragm. After the sound passes through front volume aperture 2227 it enters a substantially U-shaped channel 2229 that is coupled between the front volume aperture and sound port 2203. U-shaped channel 2229 includes a first portion 2230 that directs sound from front volume aperture 2227 in a direction away from front cover 2217 towards rear cover 2220. A second portion 2231 of U-shaped channel 2229 directs sound in a direction that is parallel to and away from diaphragm 2208. A third portion 2232 of U-shaped channel 2229 directs sound in a direction away from rear cover 2220 towards front cover 2217 and out of the sound port 2203.

In some embodiments second portion 2231 of U-shaped channel 2229 is defined by frame 2207 and a channel cover 2233. In some embodiments U-shaped channel 2229 enables sound port 2203 to be positioned away from diaphragm 2208, acting as a sound channel that enables acoustic energy generated by driver assembly 2202 to be ported to a location remote from the driver assembly. In the embodiment illustrated in FIG. 17C, U-shaped channel 2229 enables an aperture 2247 of sound port 2203 to be positioned substantially parallel to diaphragm 2208 and located a distance greater than 1 millimeter away from the perimeter of speaker opening 2209. In other embodiments aperture 2247 of sound port 2203 can be positioned a distance at least 2 millimeters away and in other embodiments at least 4 millimeters away from the perimeter of speaker opening 2209. In further embodiments aperture 2247 of sound port 2203 can be oriented differently and acoustic energy can be coupled to it from the driver assembly using a different shape of channel.

In some embodiments a panel of acoustic mesh 2234 is disposed within U-shaped channel 2229 and can have a perimeter attached to one or more walls 2235 that define the U-shaped channel. In various embodiments the perimeter of acoustic mesh 2234 can be insert-molded with one or more walls 2235 such that the acoustic mesh is an integral portion of frame 2207. In some embodiments acoustic mesh 2234 can be oriented at an angle with respect to a plane of the diaphragm and/or a centerline of U-shaped channel 2229 to maximize a cross-sectional area of the acoustic mesh within the U-shaped channel. That is, instead of being oriented perpendicular to a longitudinal axis of U-shaped channel 2229, acoustic mesh 2234 can be oriented at an angle to increase the area of the acoustic mesh within the U-shaped channel. Maximizing the cross-sectional area of acoustic mesh 2234 can enable less attenuation of the acoustic energy and less distortion of the sound as it passes through the acoustic mesh.

In some embodiments U-shaped channel 2229 and resonant cavity 2223 (see FIG. 17B) can be designed in conjunction with each other such that the U-shaped channel can result in attenuation of the frequency response in a particular frequency range and the resonant cavity can be designed to compensate for the attenuation such that audio module 2200 meets a desired frequency response requirement. More specifically, in some embodiments it may be desirable to for audio module 2200 to have equal loudness throughout the audible frequency range. U-shaped channel 2229 can act as a quarter wave resonant tube causing the sound waves in the tube to be 180 degrees out of phase with the sound waves of the driver assembly resulting in a reduction in loudness above the resonant frequency of the U-shaped channel. To compensate for the reduction in loudness, resonant cavity 2223 can be tuned to resonate at the same frequency as the quarter wave resonance of sound port 2203. In some embodiments resonant cavity 2223 can extend the audible frequency bandwidth to increase loudness above and below the resonant frequency of the U-shaped channel. In various embodiments proper tuning of resonant cavity 2223 may utilize damping to widen the effective frequency range of the resonant cavity. Resonant cavity port 2225 can be used as such a damper to increase flow resistance to the air traveling in the narrow cross-sectional area of the port.

Figure 17D:
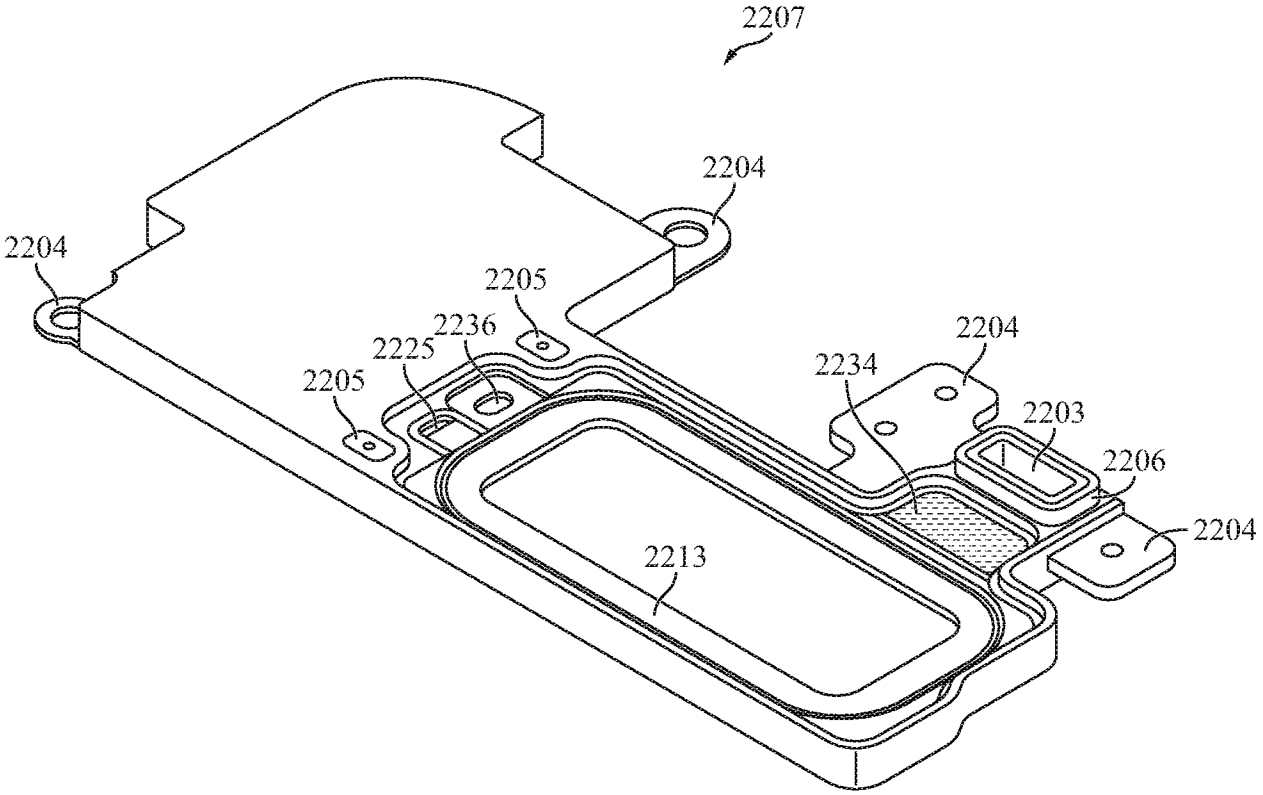
FIG. 17D illustrates an isometric front view of a frame that forms a portion of the audio module illustrated in FIG. 17A.

FIG. 17D illustrates an isometric front view of frame 2207 that forms a portion of audio module 2200 illustrated in FIG. 17A. As shown in FIG. 17D, in some embodiments frame 2207 is an integrally formed structure that includes one or more electrical connections 2205, one or more mounting tabs 2204, acoustic mesh 2234, top flux plate 2213 and one or more gaskets 2206 that are all formed as integral portions of frame. In some embodiments frame 2207 can be formed by performing a first insert molding operation that includes one or more electrical connections 2205, one or more mounting tabs 2204, acoustic mesh 2234 and top flux plate 2213. A second insert molding operation can be performed on the resulting assembly to form one or more gaskets 2206 on sound port 2203 (see FIG. 17A). In some embodiments one or more gaskets 2206 can be formed using a low durometer rated material such as a rubber or silicone and can form not only an acoustic seal to the electronic device within which acoustic module 2200 is mounted, but can also form a water-tight seal to the electronic device. Frame 2207 can be made from a plastic material that is formulated to work with an insert-molding process.

Frame 2207 can also include a barometric vent 2236 that allows air into back volume 2222 (by way of the sound port 2203, and out of the back volume to the sound port such that the back volume equilibrates with ambient air (e.g., air outside of the electronic device). In some embodiments barometric vent 2236 is covered with a porous material that enables back volume 2222 (see FIG. 17B) to equilibrate with ambient air but does not allow acoustic energy to pass between the back volume and front volume 2218.

Frame 2207 can further include resonant cavity port 2225 that couples front volume 2218 (see FIG. 17B) with resonant cavity 2223. In some embodiments resonant cavity 2223 can be used to adjust the frequency response of audio module 2200, as described above.

Figure 17E:
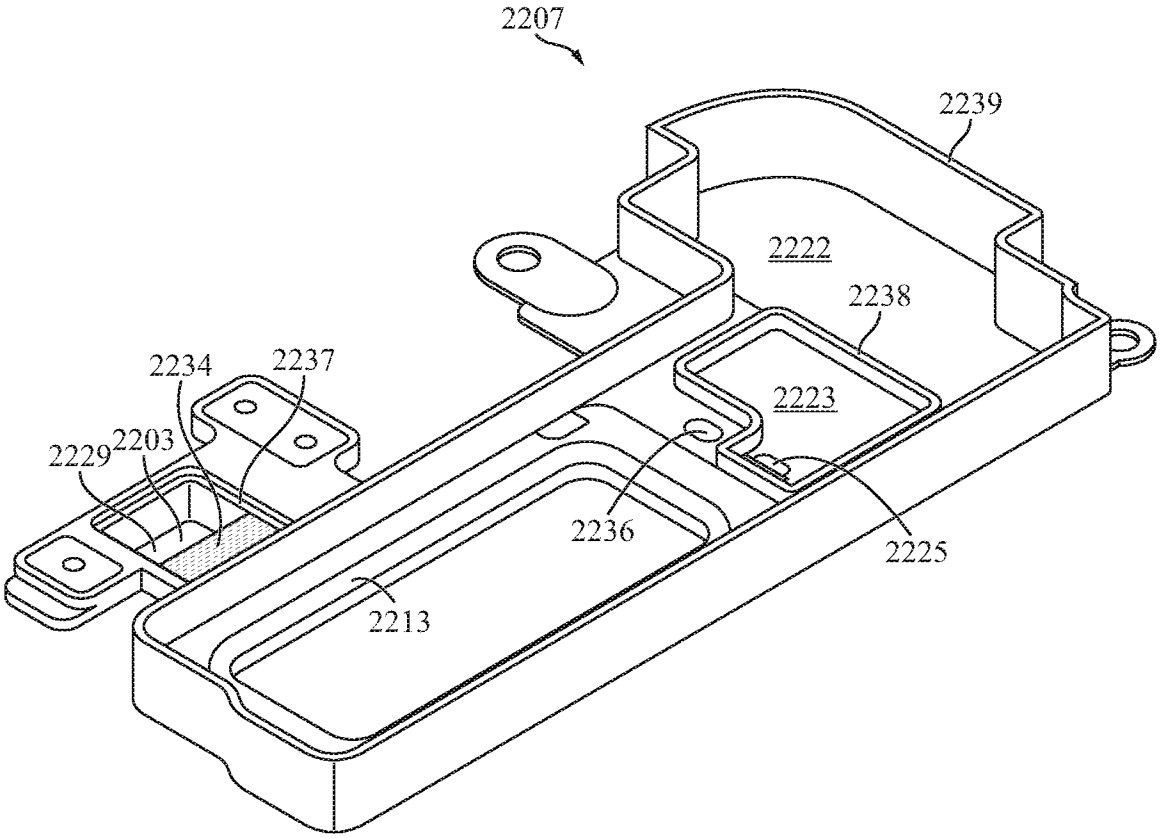
FIG. 17E illustrates an isometric back view of a frame that forms a portion of the audio module illustrated in FIG. 17A.

FIG. 17E illustrates an isometric back view of frame 2207 that forms a portion of audio module 2200 illustrated in FIG. 17A. As shown in FIG. 17E, in some embodiments frame 2207 includes a portion of resonant cavity 2223 that is coupled to front volume 2218 with resonant cavity port 2225. A resonant cavity cover (not shown in FIG. 17D) can be attached to resonant cavity wall 2238. A portion of an outer wall 2239 of frame 2207 defines a portion of back volume 2222 and a rear cover (not shown in FIG. 17D) can be attached to the outer wall of the frame to seal the back volume from the internal portion of electronic device in which audio module 2200 is mounted.

More specifically, back volume 2222 can be sealed from air within an electronic device (such as electronic device 100 in FIG. 1) so that diaphragm 2208 is not influenced by air pressure changes within the electronic device. Front volume 2218 can similarly be sealed from air pressure within the electronic device such that the only opening between enclosure 2201 and the ambient environment is sound port 2203. All other portions of enclosure 2201 can be sealed. Sealing enclosure 2201 can insure that diaphragm 2208 is not influenced by air fluctuations within the electronic device, for example when electronic device 100 (see FIG. 1) includes a touch sensitive, and/or force sensitive display that is routinely depressed by a user causing air pressure fluctuations within the enclosure.

Channel cover 2233 (not shown in FIG. 17D) can be attached to frame 2207 along perimeter 2237 to form a portion of U-shaped channel 2229. The various covers described herein can be made from a plastic or a metal material and attached to frame 2207 with any method including an adhesive, ultra-sonic welding, heat staking, soldering, brazing, or any other process. In some embodiments the covers can be attached and an additional sealing material can be applied over the attachment area using a material such as, for example an epoxy or sealant.

Figure 17F:
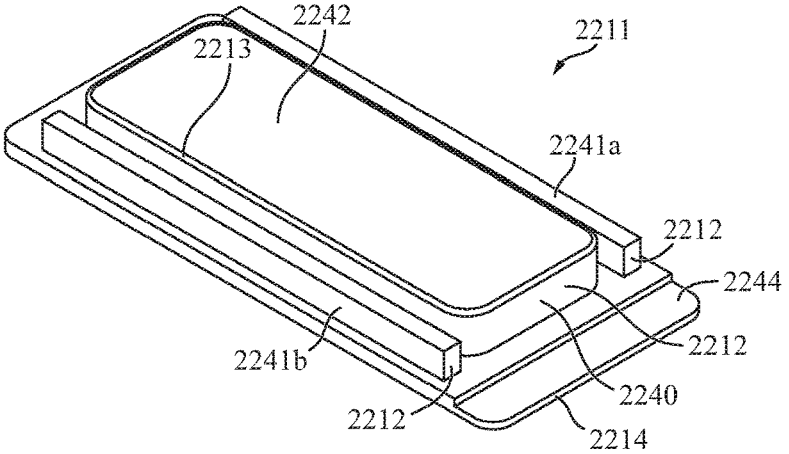
FIG. 17F illustrates an isometric view of a magnetic assembly that can be used in the audio module illustrated in FIG. 17A.

FIG. 17F illustrates an isometric view of magnetic assembly 2211. In some embodiments magnetic assembly 2211 includes one or more magnets 2212 that can include a center magnet 2240 and a pair of outer magnets 2241*a*, 2241*b* that are positioned between bottom flux plate 2214 and top flux plate 2213. In some embodiments top flux plate 2213 includes a center portion 2242 and an outer portion (shown in FIG. 17D) that is formed as a portion of frame 2207. In various embodiments, bottom flux plate 2214 can form a first portion of rear cover 2220 (see FIG. 17B) that is secured to frame 2207 to define a portion of back volume 2222, as described in more detail below. Bottom flux plate 2214 can include a first lip 2244 that can be coupled with another portion of rear cover 2200 as discussed below. Top flux plate 2213 and bottom flux plate 2214 can be formed from any high permeability material such as, for example a low-carbon steel. One or more magnets 2212 can be made from any magnetic material including, but not limited to rare-earth materials such as neodymium.

Figure 17G:
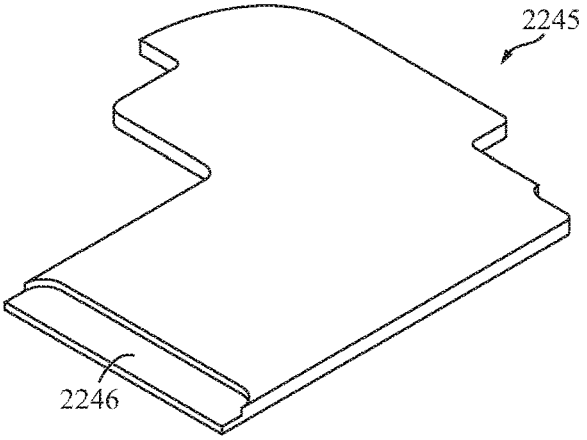
FIG. 17G illustrates an isometric view of a second portion of a rear cover that forms a portion of an enclosure of the audio module illustrated in FIG. 17A.

FIG. 17G illustrates an isometric view of a second portion 2245 of rear cover 2220 that forms a portion of enclosure 2201 of audio module 2200 illustrated in FIG. 17A. As shown in FIG. 17G second portion 2245 of rear cover 2220 includes a second lip 2246 that is configured to interface with first lip 2244 of bottom flux plate 2214. More specifically, bottom flux plate 2214 and second portion 2245 of rear cover 2220 can be secured together at first and second lips, 2244, 2246, respectively, to form a unitary rear cover 2220 that can be secured to frame 2207 to form a sealed back volume 2222 (see FIG. 17B).

Figure 18:
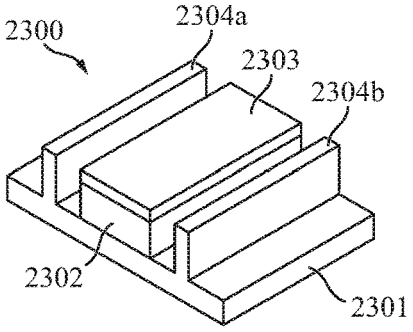
FIG. 18 illustrates an isometric view of an alternative embodiment of a magnet assembly that can be used in the audio module illustrated in FIG. 17A.

FIG. 18 illustrates an isometric view of an alternative embodiment of a magnet assembly 2300 that can be used in place of magnet assembly 2211 (see FIG. 17F). As shown in FIG. 18, magnet assembly 2300 uses a metal injection molded (MIM) formed bottom flux plate 2301, a center magnet 2302 and a top flux plate 2303. Bottom flux plate 2301 includes two raised outer sections 2304*a*, 2304*b*. Center magnet 2302 is positioned between top flux plate 2303 and bottom flux plate 2301. Other geometries and configurations of magnet assembly 2300 are within the scope of this disclosure.

Thermal Distribution Assembly

Figure 19:
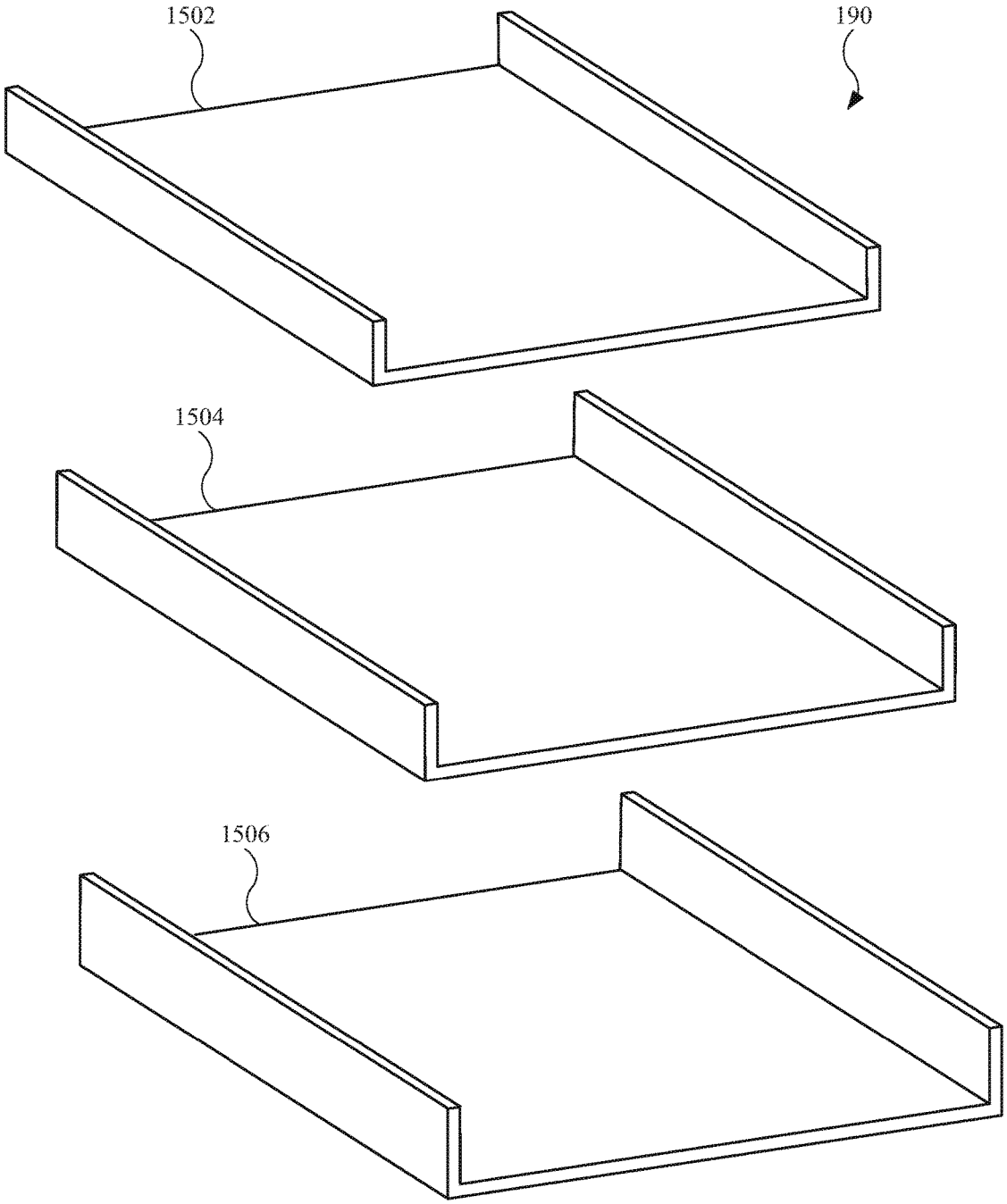
FIG. 19 illustrates an exploded view of a thermal distribution assembly, in accordance with some described embodiments.

FIG. 19 illustrates an exploded view of the thermal distribution assembly 190, in accordance with some described embodiments. The thermal distribution assembly 190 may include several layers of material that provide not only heat transfer properties, but also structural support. The enhanced heat transfer properties and structural support may be useful when the thermal distribution assembly 190 is used in an electronic device (not shown) having a substantially non-metal exterior, such as the electronic device 100 (shown in FIG. 2).

As shown, the thermal distribution assembly 190 may include several layers of material. For example, the thermal distribution assembly 190 may include a first layer 1502 formed from a first type material, which may include a durable material, such as stainless steel. The thermal distribution assembly 190 may further include a second layer 1504 formed from a second type material, which may include a material having a relatively high thermal conductivity, such as copper or graphite. In this regard, the second layer 1504 may be designed to redistribute, redirect, or otherwise spread heat away from a heat-generating component (not shown) that is thermal coupled with the thermal distribution assembly 190. For example, the thermal distribution assembly 190 may include a first layer 1502 formed from a third type material. However, the third type material may also include a durable material, such as stainless steel.

In order to assemble the thermal distribution assembly 190, the various layers may undergo a cladding operation designed to bond the layers together of different material makeup. The cladding operation can include each layer of material on separate rollers, and then receiving each of the layers and pressing the layers together. The pressing effect may create molecular bonds between molecules of the metals. It should be noted that the cladding operation can be used when the second layer 1504 includes copper. A different assembly operation may be used when the second layer 1504 includes graphite. This will be illustrated below. Also, when assembled, the first layer 1502 and the third layer 1506 may provide a supporting structure for the second layer 1504, and may also provide some structural support to an electronic device (not shown) that carries the thermal distribution assembly 190.

Figure 20:
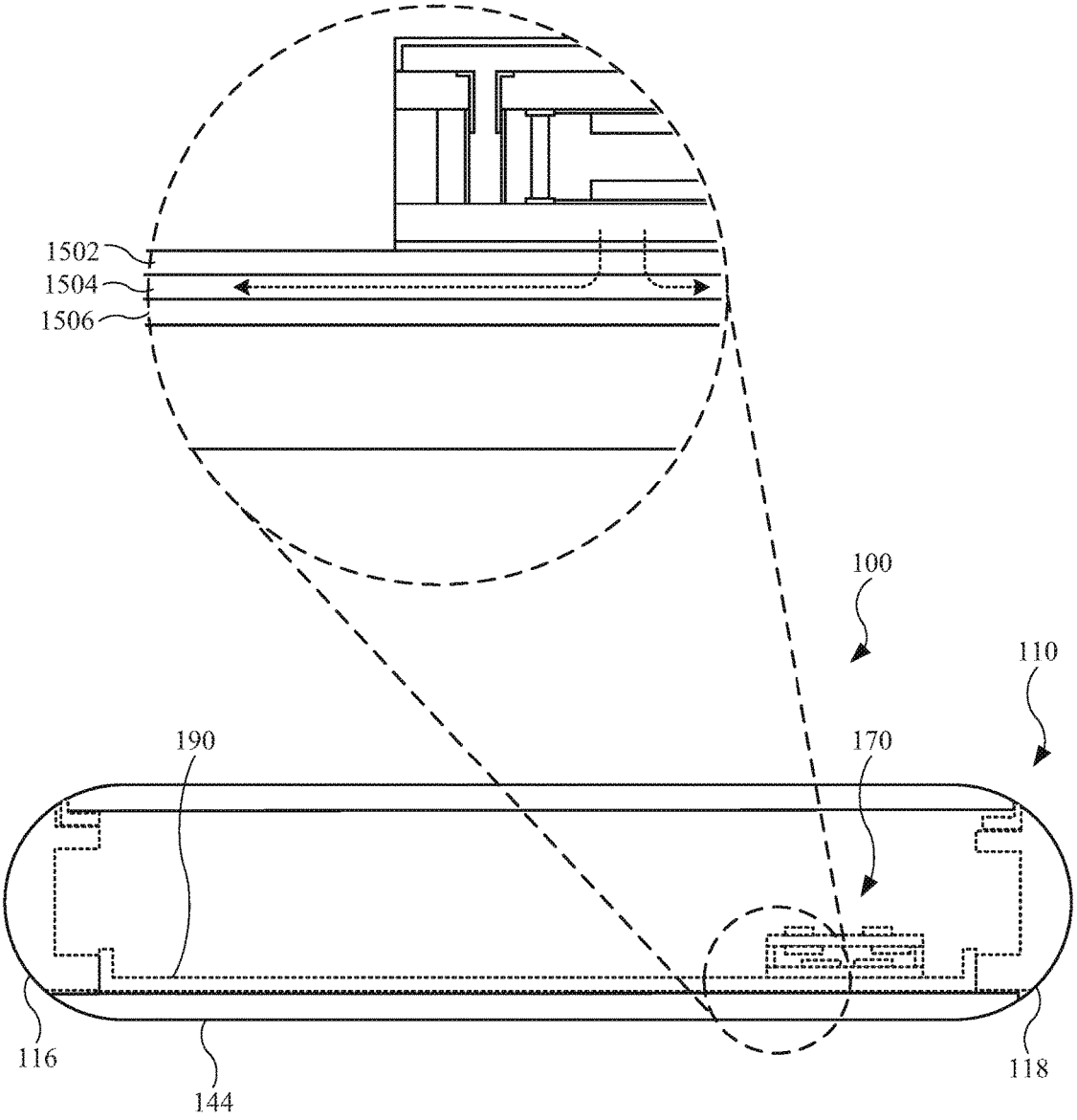
FIG. 20 illustrates a side view of an embodiment of the electronic device, showing the thermal distribution assembly positioned in the electronic device.

FIG. 20 illustrates a side view of an embodiment of the electronic device 100, showing the thermal distribution assembly 190 positioned in the electronic device 100. As shown, the thermal distribution assembly 190 may be thermally coupled with the circuit assembly 170 such that heat generated from operational components of the circuit assembly 170 may be extracted from the circuit assembly 170 by the thermal distribution assembly 190. Also, in some instances, the thermal distribution assembly 190 engages the band 110. For example, the thermal distribution assembly 190 may engage the third part 116 and the fourth part 118, both of which are metal sidewall features of the band 110. In this regard, the thermal distribution assembly 190 may thermally couple with the band 110, and the thermal distribution assembly 190 may provide a thermal bridge between the circuit assembly 170 and the band 110. For example, as shown in the enlarged view, the second layer 1504 of the thermal distribution assembly 190 may receive heat (represented by dotted lines with arrow) generated from operational components of the circuit assembly 170. The heat may pass through the second layer 1504 and to the band 110, wherein the heat may dissipate to the ambient air. Furthermore, the thermal distribution assembly 190 may prevent or limit the second protective layer 144 from receiving thermal energy generated from operational components of the circuit assembly 170.

Also, with the thermal distribution assembly 190 engaged with the band 110, the thermal distribution assembly 190 may provide a rigid layer that supports the second protective layer 144. For example, the first layer 1502 and the third layer 1506 of the thermal distribution assembly 190 may extend across a major surface of the second protective layer 144.

Figure 21:
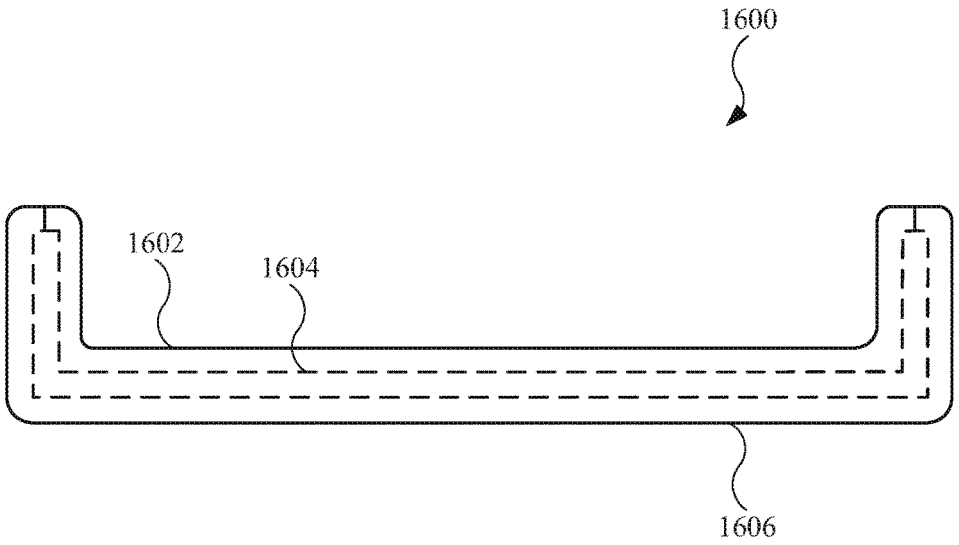
FIG. 21 illustrates a side view of an alternative embodiment of a thermal distribution assembly, in accordance with some described embodiments.

FIG. 21 illustrates a side view of an alternative embodiment of a thermal distribution assembly 1600, in accordance with some described embodiments. The thermal distribution assembly 1600 may include any material(s) and/or feature(s) previously described for a thermal distribution assembly. As shown, the thermal distribution assembly 1600 may include a first layer 1602, a second layer 1604, and a third layer 1606, with the second layer 1604 embedded between the first layer 1602 and the third layer 1606. Further, the second layer 1604 (shown as a dotted line) may be completely covered by the first layer 1602 and the third layer 1606. This may prevent movement or shifting of the second layer 1604 relative to the first layer 1602 and/or the third layer 1606.

Figure 22:
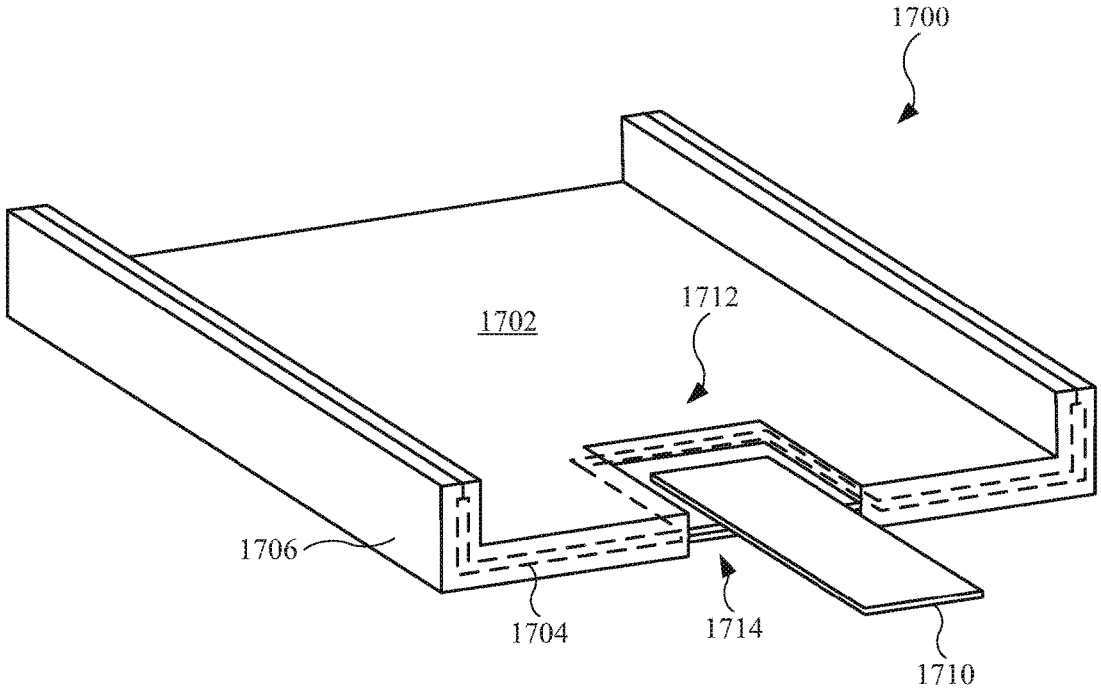
FIG. 22 illustrates an isometric view of the thermal distribution assembly shown in FIG. 21, showing the thermal distribution assembly modified to receive a component.

FIG. 22 illustrates an isometric view of the thermal distribution assembly 1700 shown in FIG. 21, showing the thermal distribution assembly 1700 modified to receive a component 1710. The thermal distribution assembly 1700 may include any material(s) and/or feature(s) previously described for a thermal distribution assembly. As shown, the thermal distribution assembly 1700 may include a first layer 1702, a second layer 1704, and a third layer 1706, with the second layer 1704 embedded between the first layer 1702 and the third layer 1706.

However, the second layer 1704 may be modified to reduce the dimensions of the thermal distribution assembly 1700. For example, a portion of the second layer 1704 may be locally removed in a desired location such that the thermal distribution assembly 1700 includes only the first layer 1702 and the third layer 1706 define the thermal distribution assembly 1700, thereby reducing (locally) the dimensions of the thermal distribution assembly 1700. As a result of the reduced dimensions, the thermal distribution assembly 1700 defines a first channel 1712 that may receive the component 1710. The reduced dimensions of the thermal distribution assembly 1700 further define a second channel 1714 that may receive a second component (not shown).

The component 1710 can be secured with the thermal distribution assembly 1700 by welding, soldering, or adhering (by adhesives), as non-limiting examples. Also, the dimensions of the first channel 1712 allow the component 1710 to be seated in the thermal distribution assembly 1700 such that the component 1710 is at least co-planar with respect to the first layer 1702, or even sub-flush with respect to the first layer 1702. It should be noted that the dimensions of the second channel 1714 may allow a second component (not shown) to be seated in the thermal distribution assembly 1700 such that the second component is at least co-planar with respect to the third layer 1706, or even sub-flush with respect to the third layer 1706. Also, the component 1710 may be representation of one or more components, such as a circuit assembly that includes one or more circuit boards, an audio module, a bracket, or a joint, as non-limiting examples.

Figure 23:
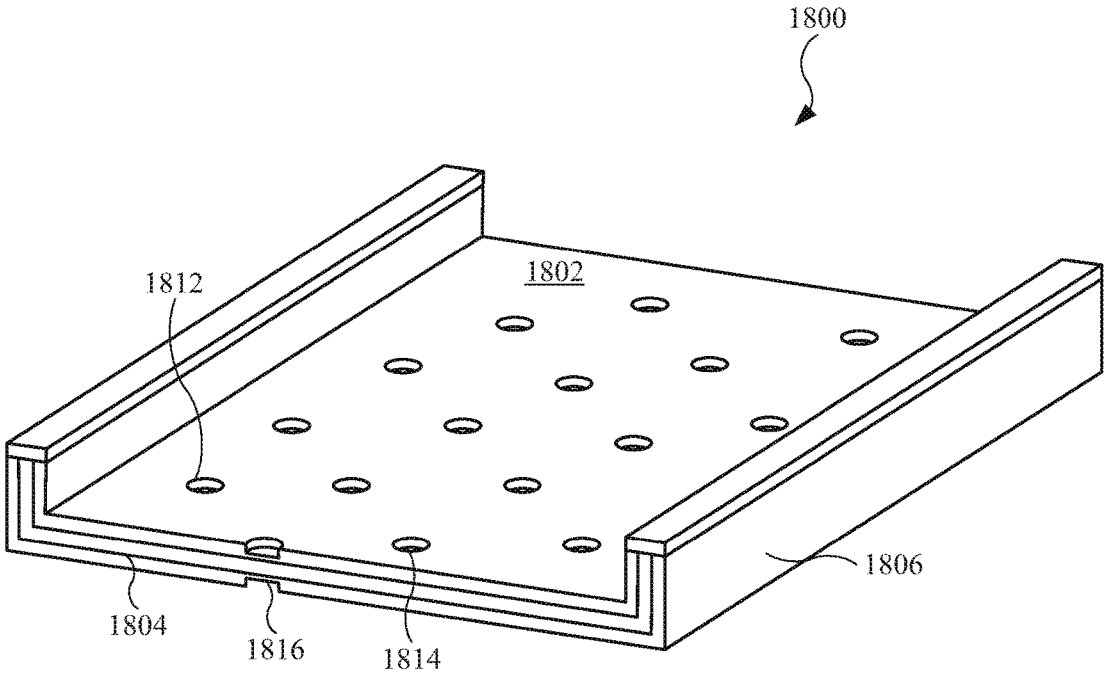
FIG. 23 illustrates an isometric view of an alternative embodiment of a thermal distribution assembly, in accordance with some described embodiments.

FIG. 23 illustrates an isometric view of an alternative embodiment of a thermal distribution assembly 1800, in accordance with some described embodiments. The thermal distribution assembly 1800 may include any material(s) and/or feature(s) previously described for a thermal distribution assembly. As shown, the thermal distribution assembly 1800 may include a first layer 1802, a second layer 1804, and a third layer 1806, with the second layer 1804 between the first layer 1802 and the third layer 1806.

In some embodiments, the second layer 1804 includes a metal, such as copper. In the embodiment shown in FIG. 23, the second layer 1804 includes graphite. In order to bond the second layer 1804 with the first layer 1802 and the third layer 1806, the thermal distribution assembly 1800 may undergo a welding operation. For example, as shown in FIG. 13, the a thermal distribution assembly 1800 include several welds, such as a first weld 1812 and a second weld 1814 that are representative of several welds between the first layer 1802 and the second layer 1804. However, the thermal distribution assembly 1800 may include several welds between the third layer 1806 and the second layer 1804, as represented by the third weld 1816. By welding the second layer 1804 with the first layer 1802 and the third layer 1806, the second layer 1804 may resist shear forces that would otherwise displace the second layer with respect to the first layer 1802 and the third layer 1806, particularly when the second layer 1804 includes a granular material, such as graphite.

Figure 24:
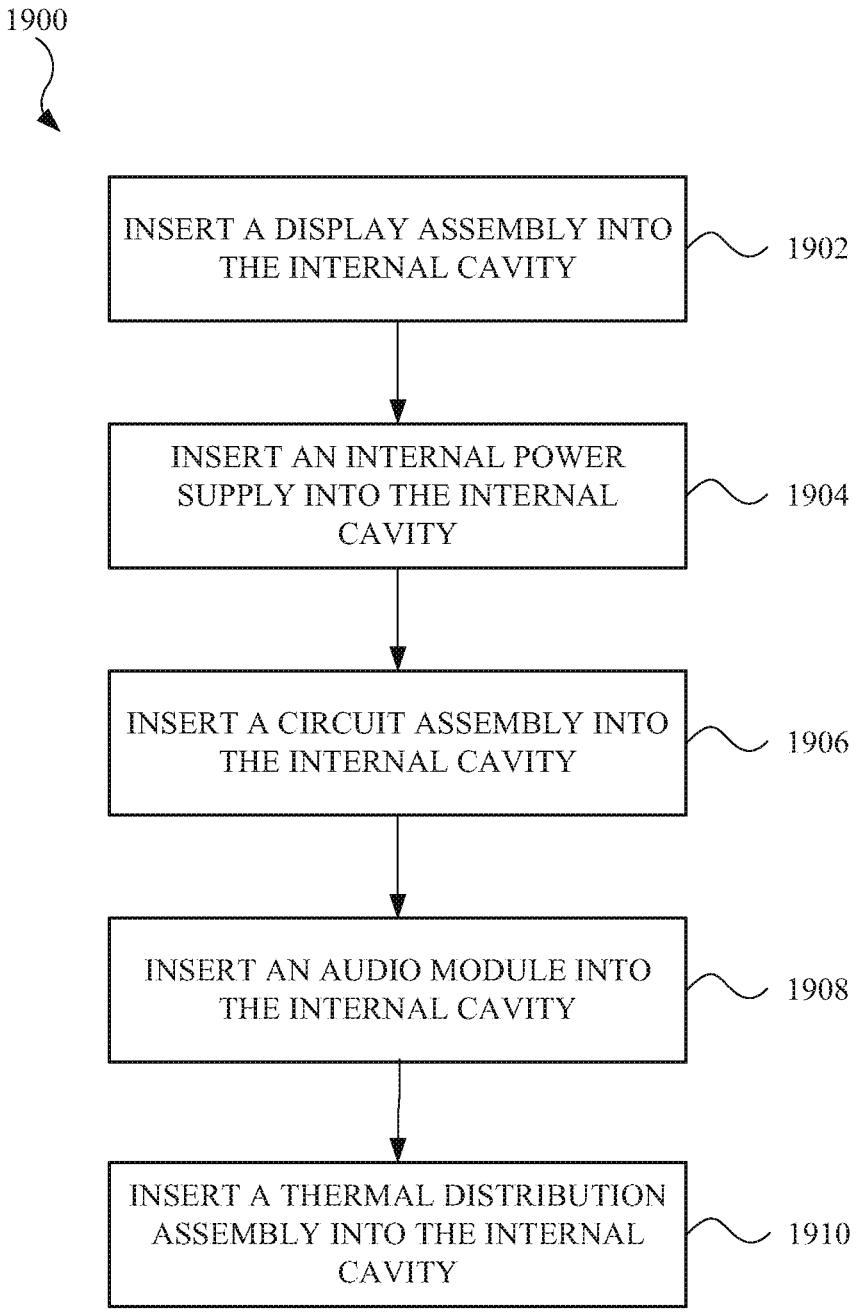
FIG. 24 illustrates a flowchart showing a method for forming an electronic device, in accordance with some described embodiments.

FIG. 24 illustrates a flowchart 1900 showing a method for forming an electronic device, in accordance with some described embodiments. The electronic device may include a band formed from a metal defining a metal ring. Further, the band may be split into multiple sections, with the multiple sections electrically isolated from each other. Also, the band may be secured with a protective layer formed from a transparent material, such as glass, plastic, or sapphire. In this manner, the band may combine with the protective layer to form an internal cavity that receives several internal components.

In step 1902, a display assembly is inserted into the internal cavity. The display assembly may include a touch sensitive layer, a display, and a force sensitive layer. The display may include an OLED display designed to flex or bend. Also, a protective layer formed from a transparent material may cover the display assembly. The protective layer may secure with a frame having a notch, or undercut, that partially receives the display as well as a flexible circuit that electrically and mechanically couples with the touch sensitive layer. However, in another location, the frame may not include the notch. In some embodiments, the force sensitive layer is electrically and mechanically coupled with a flexible that a location in which the frame does not include the notch. Accordingly, the touch sensitive layer and the force sensitive layer may electrically and mechanically couple with their respective flexible circuits in different locations of the electronic device.

In step 1904, an internal power supply is inserted into the internal cavity. The internal power supply may include several electrodes formed by a die cutting process. In this manner, the internal power supply may take on a generally rectangular shape. The die cutting operation allows for a variety of shapes and sizes, and may maximize the volume of the internal power supply to improve the energy storage of the internal power supply. Also, the internal power supply may include channel designed to create space for components, such as a flexible circuit. In this manner, various internal components (such as antennae) may be rearranged in different locations and be in electrical communication with other components by way of the flexible circuit (or flexible circuits) passing along the channel.

In step 1906, a circuit assembly is inserted into the internal cavity. The circuit assembly may include two (or more) circuit boards in a stacked configuration, in which a first circuit board is positioned over a second circuit board, as an example. The stacked configuration may create additional space in the internal cavity for other components, such as the internal power supply. The first circuit board may carry operational components (integrated circuits, transistors, etc.) on at least two opposing surfaces, with one of the surfaces facing a surface of the second circuit board. Further, the second circuit board may also carry several operational components on the surface facing the surface of the first circuit board. Also, operational components on the same surface may be in communication with each other by several metal traces, while operational components on opposing surfaces of a circuit board may be in communication with each other by a via (or by several vias). Also, operational components on different (stacked) circuit boards may be in communication with each other by several interposer boards designed to carry signals between the first circuit board and the second circuit board. Alternatively, or in combination, a flexible circuit may be electrically coupled with the first circuit board and the second circuit board by a hot bar soldering operation.

In step 1908, an audio module is inserted into the internal cavity. The audio module may include a housing that carries several internal components, such as a diaphragm, a sound coil and a magnet, as non-limiting examples. The housing may include an opening aligned with an opening (or openings) of the band. Also, the diaphragm, as well as structural features that support the diaphragm, may separate the housing into a front volume and a back volume. The front volume may be in communication with the opening, while the back volume is sealed from air pressure in the internal cavity. In this manner, the diaphragm is not influenced by fluctuations in air pressure in the internal cavity.

In step 1910, a thermal distribution assembly is inserted into the internal cavity. The thermal distribution assembly may include a first layer, a second layer, and a third layer, with the second layer positioned between the first layer and the second layer. The first layer may include a first type material, which can include metal such as stainless steel. The second layer may include a second type material, which can include copper or graphite. The third layer may include the first type material. The second layer is designed to provide a thermally conductive path for the electronic device, while the first layer and the third layer provide a protective cover for the second layer as well as structural support for the electronic device. Also, the thermal distribution assembly may limit or prevent the protective cover (that defines the internal cavity) from excessive heat to avoid injury to a user.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An audio module for an electronic device, the audio module comprising:
- a driver assembly comprising:
  - a diaphragm defining a speaker plane; and
  - a voice coil attached to the diaphragm and positioned adjacent one or more magnets; and
- an enclosure surrounding the driver assembly and defining:
  - a front volume positioned on a first side of the speaker plane and coupled to a sound port;
  - a back volume positioned on the first side of the speaker plane and on a second side of the speaker plane; and
  - a resonant cavity coupled to the front volume via a resonant cavity port and separated from the back volume by a resonant cavity cover.

2. The audio module of claim 1 wherein a first portion of the resonant cavity is positioned on the first side of the speaker plane and a second portion of the resonant cavity is positioned on the second side of the speaker plane.

3. The audio module of claim 1 wherein the back volume is further defined by a frame, the diaphragm and a rear cover attached to the frame.

4. The audio module of claim 3 wherein the driver assembly includes a bottom flux plate that forms a portion of the rear cover.

5. The audio module of claim 1 wherein a substantially U-shaped channel couples the front volume to the sound port.

6. The audio module of claim 5 further comprising a panel of acoustic mesh positioned within the substantially U-shaped channel and partially embedded within one or more walls that define the substantially U-shaped channel.

7. The audio module of claim 6 wherein the panel of acoustic mesh is oriented at an angle with respect to the speaker plane.

8. The audio module of claim 1 wherein the resonant cavity is sized to resonate at a frequency that extends a bandwidth of the audio module.

9. The audio module of claim 1 further comprising a barometric vent coupling the front volume to the back volume.

10. An audio module for an electronic device, the audio module comprising:
- a frame;
- a driver assembly disposed within the audio module and including a diaphragm that defines a speaker plane;
- a front cover attached to the frame and positioned parallel to and spaced apart from the diaphragm in a first direction, wherein the front cover, the diaphragm and the frame define a front volume;
- a back volume positioned at least partially on a first side of the speaker plane and at least partially on a second side of the speaker plane;
- a front volume aperture coupled to the front volume;
- a rear cover attached to the frame and positioned parallel to and spaced apart from the diaphragm in a second direction that is opposite the first direction; and
- a substantially U-shaped channel that couples acoustic energy from the front volume aperture to a sound port defined by the frame.

11. The audio module of claim 10 wherein the substantially U-shaped channel includes:
- a first portion that receives sound from the front volume and is positioned adjacent a perimeter of the diaphragm;
- a second portion that receives sound from the first portion and is oriented transverse to the first portion;
- a third portion that directs sound received from the second portion to the sound port and is coupled to a distal end of the second portion.

12. The audio module of claim 10 wherein a portion of the substantially U-shaped channel is formed by a channel cover that is attached to the frame.

13. The audio module of claim 10 wherein the panel of acoustic mesh is oriented at an angle with respect to a plane of the diaphragm.

14. The audio module of claim 10 wherein the panel of acoustic mesh is insert-molded within the frame.

15. An electronic device comprising:

a device enclosure;

a display assembly coupled to the device enclosure, the combination thereof defining an interior volume, wherein the display assembly includes a touch sensitive layer and a force sensitive layer; and an audio module disposed within the interior volume and comprising:

(1) a driver assembly including:

a diaphragm defining a speaker plane; and a voice coil attached to the diaphragm and positioned adjacent one or more magnets; and (2) an audio module enclosure surrounding the driver assembly and defining:

a front volume coupled to a speaker opening formed in the device enclosure;

a back volume positioned on the first side of the speaker plane and on a second side of the speaker plane; and a resonant cavity coupled to the front volume via a resonant cavity port and separated from the back volume by a resonant cavity cover.

16. The electronic device of claim 15 further comprising a top flux plate in contact with a top surface of the one or more magnets and a bottom flux plate in contact with a bottom surface of the one or more magnets.

17. The audio module of claim 15 further comprising a substantially U-shaped channel that couples the front volume to the speaker opening.

18. The electronic device of claim 17 wherein a panel of acoustic mesh is positioned within the substantially U-shaped channel and is oriented at an angle with respect to the speaker plane.

19. The electronic device of claim 15 wherein the back volume is further defined by a frame, the diaphragm and a rear cover attached to the frame.

20. The electronic device of claim 15 further comprising a barometric vent coupling the front volume to the back volume.

* * * * *